US008539929B2

(12) United States Patent
Dees et al.

(10) Patent No.: US 8,539,929 B2
(45) Date of Patent: Sep. 24, 2013

(54) CYLINDER HEAD COOLING SYSTEM

(75) Inventors: Jesse L. Dees, Slinger, WI (US); Michael S. Carlin, Sussex, WI (US); Scott B. Cain, Cascade, WI (US); Dan M. Sepic, Mukwonago, WI (US); Terry J. Rumpel, West Bend, WI (US); Matt G. Hoffmann, Milwaukee, WI (US); Scott A. Koerner, Allenton, WI (US); Rick W. Elchert, Mequon, WI (US); Brian E. Healy, Hartland, WI (US); Stephann E. Balthazar, Milwaukee, WI (US); Nicolae Glaja, Chesnee, SC (US)

(73) Assignee: Harley-Davidson Motor Company, Milwaukee, WI (US)

( * ) Notice: Subject to any disclaimer, the term of this patent is extended or adjusted under 35 U.S.C. 154(b) by 961 days.

(21) Appl. No.: 12/621,240

(22) Filed: Nov. 18, 2009
(Under 37 CFR 1.47)

(65) Prior Publication Data

US 2011/0114044 A1 May 19, 2011

(51) Int. Cl.
*F02B 77/13* (2006.01)

(52) U.S. Cl.
USPC ..... 123/198 E; 123/41.51; 180/229; 180/68.1

(58) Field of Classification Search
USPC ..... 123/41.82 R, 41.57–41.58, 41.51, 123/195 R, 195 C, 198 E; 180/68.1–68.4, 180/68.6, 229; 165/44, 51
See application file for complete search history.

(56) References Cited

U.S. PATENT DOCUMENTS

| | | | | |
|---|---|---|---|---|
| 4,618,020 | A * | 10/1986 | Noda et al. | 180/229 |
| 4,632,206 | A * | 12/1986 | Morinaka et al. | 180/229 |
| 4,640,341 | A * | 2/1987 | Ozawa | 165/41 |
| 4,714,058 | A | 12/1987 | Oda et al. | |
| 4,873,944 | A | 10/1989 | Yamada | |
| 4,953,631 | A | 9/1990 | Kimura | |
| 4,972,807 | A | 11/1990 | Morishita | |

(Continued)

FOREIGN PATENT DOCUMENTS

| | | | |
|---|---|---|---|
| CN | 1542269 | A | 11/2004 |
| EP | 0601612 | B1 | 6/1994 |

(Continued)

OTHER PUBLICATIONS

Custom Motorcycle Having Radiators for a Liquid-Cooled Engine Positioned in the Lowers. Motorcycle was publicly displayed more than one year prior to Nov. 18, 2009. Figures 1 and 2 attached.

*Primary Examiner* — Hung Q Nguyen
(74) *Attorney, Agent, or Firm* — Michael Best & Friedrich LLP

(57) ABSTRACT

A cylinder head for a motorcycle engine, which has a pair of cylinders arranged in a "V" configuration such that the cylinders converge toward a crankshaft axis and such that a space is defined between the cylinders at an upper extent of each of the cylinders. The cylinder head includes a base configured to be coupled to one of the cylinders, an intake side including an intake passage and an intake valve movable disposed within the intake passage, the intake side being positioned adjacent the space, and an exhaust side including an exhaust passage and an exhaust valve movable disposed within the exhaust passage, the exhaust side being positioned remote from the space. A cooling liquid inlet port and a cooling liquid discharge port are located on the intake side. A cooling liquid passage runs through the cylinder head to reduce an operating temperature of the cylinder head.

20 Claims, 19 Drawing Sheets

(56) References Cited

U.S. PATENT DOCUMENTS

| | | | | |
|---|---|---|---|---|
| 4,993,227 | A | 2/1991 | Nagura et al. | |
| 5,081,960 | A | 1/1992 | Shimamoto | |
| 5,152,256 | A | 10/1992 | Yamauchi et al. | |
| 5,176,111 | A * | 1/1993 | Nakamura et al. | 123/41.01 |
| RE34,226 | E | 4/1993 | Morishita | |
| 5,379,729 | A | 1/1995 | Yonezwa et al. | |
| 5,715,778 | A | 2/1998 | Hasumi et al. | |
| 5,743,218 | A | 4/1998 | Aupperle et al. | |
| 5,799,627 | A | 9/1998 | Dohn et al. | |
| 5,984,035 | A | 11/1999 | Katoh et al. | |
| 5,992,554 | A * | 11/1999 | Hasumi et al. | 180/229 |
| 6,032,621 | A | 3/2000 | Tateshima | |
| 6,071,158 | A | 6/2000 | Mashiko | |
| 6,158,400 | A | 12/2000 | Collie et al. | |
| 6,305,332 | B1 | 10/2001 | Nishi et al. | |
| 6,332,505 | B1 * | 12/2001 | Tateshima et al. | 180/229 |
| 6,422,182 | B1 * | 7/2002 | Ohta | 123/41.29 |
| 6,499,444 | B1 | 12/2002 | Batzill et al. | |
| 6,505,581 | B2 | 1/2003 | Niizuma et al. | |
| 6,799,540 | B2 | 10/2004 | Akiwa et al. | |
| 6,827,049 | B2 | 12/2004 | Oh | |
| 6,883,472 | B2 | 4/2005 | Krotky et al. | |
| 6,928,964 | B2 | 8/2005 | Obermayer et al. | |
| 6,981,473 | B2 | 1/2006 | Gunji et al. | |
| 6,997,144 | B2 | 2/2006 | Sugano et al. | |
| 7,007,637 | B2 | 3/2006 | Hwang | |
| 7,069,884 | B2 | 7/2006 | Baba et al. | |
| 7,069,885 | B2 | 7/2006 | Iida | |
| 7,082,904 | B2 | 8/2006 | Takano | |
| 7,159,682 | B2 | 1/2007 | Arnold | |
| 7,191,740 | B2 | 3/2007 | Baba et al. | |
| 7,194,985 | B2 | 3/2007 | Wachigai et al. | |
| 7,204,624 | B2 * | 4/2007 | Katagiri | 362/475 |
| 7,216,612 | B2 | 5/2007 | Futakuchi et al. | |
| 7,367,293 | B2 | 5/2008 | Takeuchi | |
| 7,387,180 | B2 * | 6/2008 | Konno et al. | 180/68.3 |
| 7,410,025 | B2 * | 8/2008 | Sunaguchi et al. | 180/229 |
| 7,654,357 | B2 * | 2/2010 | Buell et al. | 180/229 |
| 2004/0244735 | A1 * | 12/2004 | Takeuchi | 123/41.57 |
| 2005/0263110 | A1 | 12/2005 | Yasui | |
| 2006/0065218 | A1 | 3/2006 | Gokan et al. | |
| 2007/0074681 | A1 | 4/2007 | Shiozaki et al. | |
| 2007/0186879 | A1 | 8/2007 | Takahashi | |
| 2009/0008180 | A1 * | 1/2009 | Stefanelli et al. | 180/229 |

FOREIGN PATENT DOCUMENTS

| | | | |
|---|---|---|---|
| EP | 0376352 | B1 | 10/1994 |
| EP | 1275830 | B1 | 1/2003 |
| EP | 1507076 | A2 | 2/2005 |
| EP | 1712463 | A1 | 10/2006 |
| JP | 58096121 | | 6/1983 |
| JP | 59134319 | | 8/1984 |
| JP | 1233187 | | 9/1989 |
| JP | 1244993 | | 9/1989 |
| JP | 1289780 | | 11/1989 |
| JP | 1297385 | | 11/1989 |
| JP | 2074483 | | 3/1990 |
| JP | 2164683 | | 6/1990 |
| JP | 3064620 | A | 3/1991 |
| JP | 3065484 | | 3/1991 |
| JP | 3135886 | | 6/1991 |
| JP | 3136986 | | 6/1991 |
| JP | H03-132490 | | 6/1991 |
| JP | 3246184 | | 11/1991 |
| JP | 3287479 | | 12/1991 |
| JP | 03287479 | A * | 12/1991 |
| JP | 3287480 | | 12/1991 |
| JP | 4002587 | | 1/1992 |
| JP | 4081381 | | 3/1992 |
| JP | 5213252 | | 8/1993 |
| JP | H05-203385 | | 8/1993 |
| JP | 5286471 | | 11/1993 |
| JP | 5296682 | | 11/1993 |
| JP | 6270870 | | 9/1994 |
| JP | 7010060 | | 1/1995 |
| JP | 8085485 | | 4/1996 |
| JP | 8099669 | | 4/1996 |
| JP | H08-099669 | | 4/1996 |
| JP | 9240545 | | 9/1997 |
| JP | 11050844 | | 2/1999 |
| JP | 3087280 | B2 | 9/2000 |
| JP | 2000248938 | | 9/2000 |
| JP | 2001130467 | | 5/2001 |
| JP | 2002021989 | | 1/2002 |
| JP | 2002127977 | | 5/2002 |
| JP | 2002145155 | | 5/2002 |
| JP | 2003104265 | | 4/2003 |
| RU | 2031215 | | 3/1995 |

* cited by examiner

CYLINDER HEAD COOLING SYSTEM

BACKGROUND

The present invention relates to a cooling system for an engine, and more particularly to a liquid cooling system for cooling cylinder heads of a motorcycle engine.

Internal combustion engines used on motorcycles are typically either air cooled or liquid cooled. Air cooled engines rely on a flow of air over heat transfer surfaces such as fins to cool the engine. Liquid cooled engines use a flow of a liquid (e.g., coolant or oil) within the engine to absorb heat from the engine, and use a heat exchanger, such as a radiator, to transfer the absorbed heat in the liquid to the air.

SUMMARY

In one embodiment, the invention provides a cylinder head for a motorcycle engine that has a pair of cylinders arranged in a "V" configuration such that the cylinders converge toward a crankshaft axis and such that a space is defined between the cylinders at an upper extent of each of the cylinders. The cylinder head includes a base configured to be coupled to one of the cylinders, an intake side including an intake passage and an intake valve movably disposed within the intake passage, the intake side configured to be positioned adjacent the space, and an exhaust side including an exhaust passage and an exhaust valve movably disposed within the exhaust passage, the exhaust side configured to be positioned remote from the space. A cooling liquid inlet port and a cooling liquid discharge port are located on the intake side. A cooling liquid passage runs through the cylinder head to reduce an operating temperature of the cylinder head.

In another embodiment, the invention provides a cylinder head including an intake side having an intake passage in which an intake valve is positioned, an exhaust side having an exhaust passage in which an exhaust valve is positioned, a liquid inlet port located on the intake side, and a liquid discharge port located on the intake side. The exhaust passage has a curvature. The cylinder head also includes a liquid cooling passage extending between the liquid inlet port and the liquid discharge port. The liquid cooling passage includes a single-loop passage having a measurable length. A portion of the liquid cooling passage generally follows the curvature of the exhaust passage for at least 270 degrees of rotation.

In yet another embodiment, the invention provides a motorcycle including a frame, an engine coupled to the frame, right and left engine guards coupled to the frame forwardly of the engine and extending laterally outwardly from the frame, and right and left leg shields coupled to the right and left engine guards, respectively, a liquid cooling circuit in communication with the engine, and right and left radiators in fluid communication with the liquid cooling circuit and positioned within the right and left leg shields, respectively. In some constructions, air passing through from the right and left radiators is directed away from the motorcycle by a right and left air duct that is positioned within the right and left lowers, respectively.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
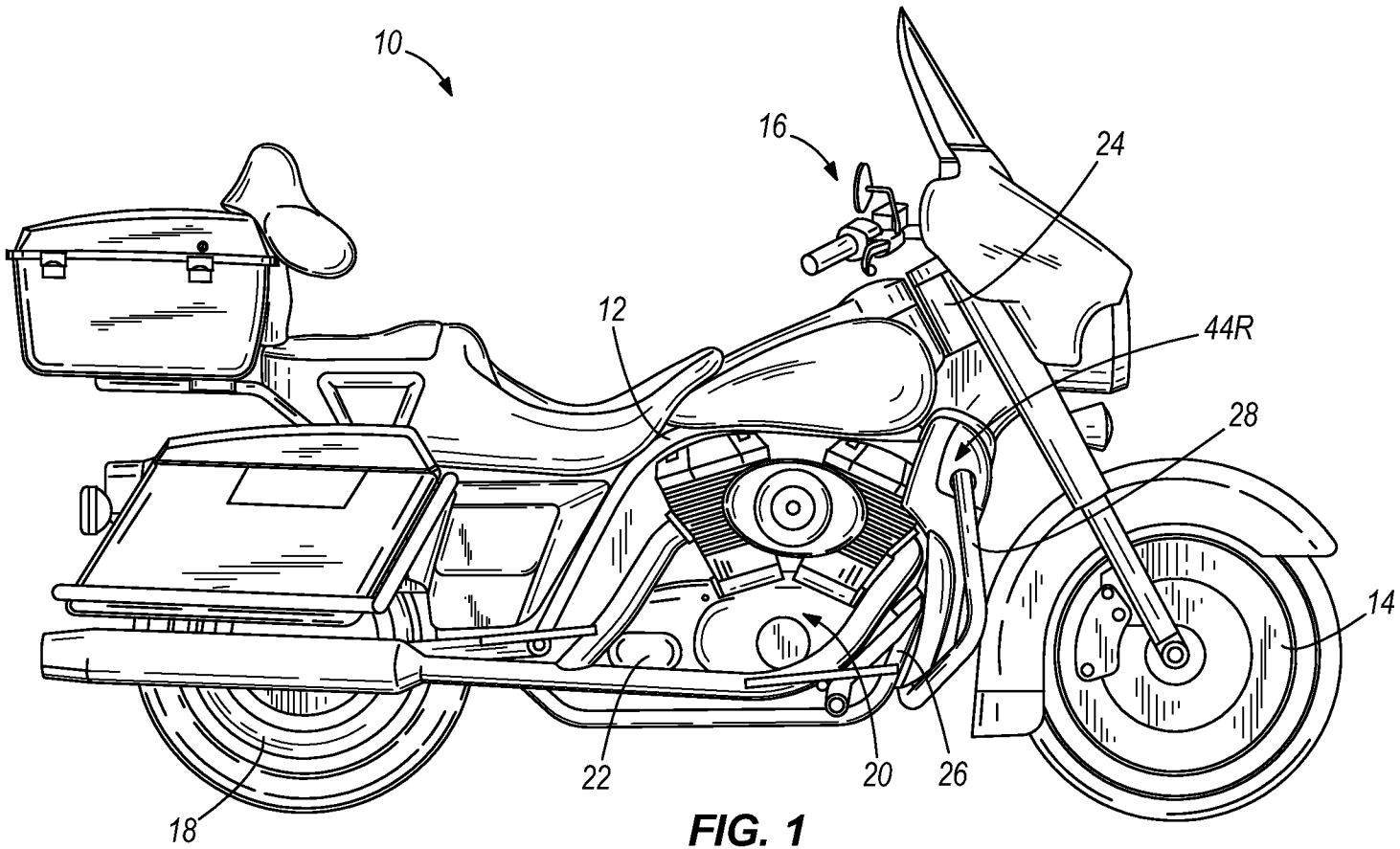
FIG. 1 is a side view of a motorcycle according to one embodiment of the invention.

FIG. 1 illustrates a motorcycle 10. The illustrated motorcycle 10 is a touring motorcycle 10 and includes a frame 12, a front wheel 14 coupled to the frame 12 through a steering assembly 16, and a rear wheel 18 coupled to the frame 12 through a swing arm assembly (not shown). The motorcycle 10 includes an engine 20 coupled to the frame 12 and operatively coupled to the rear wheel 18 through a transmission 22.

Figure 2:
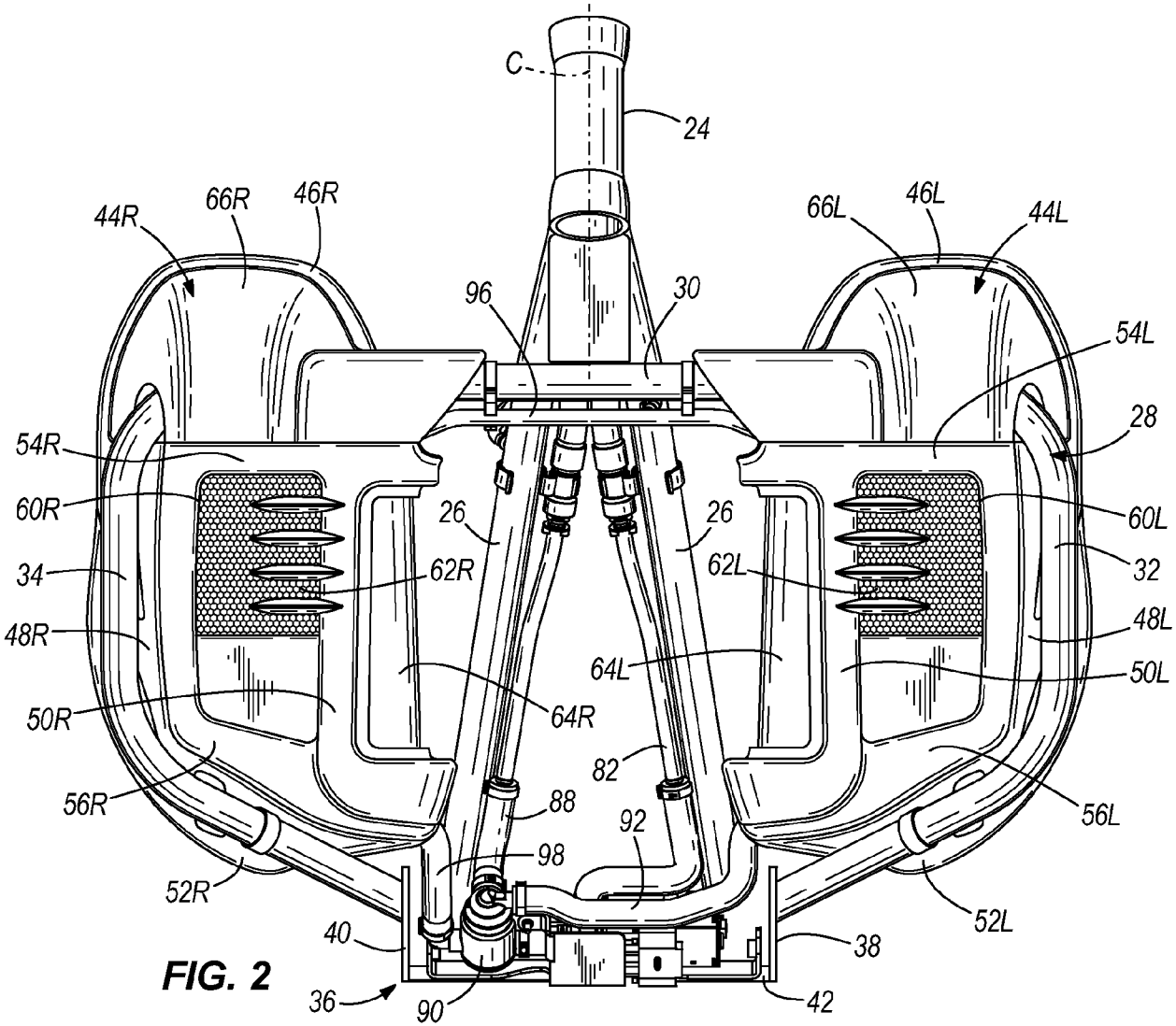
FIG. 2 is a front view of a portion of the motorcycle of FIG. 1, illustrating right and left engine guards and right and left leg shields, or "lowers", of the motorcycle.
Figure 3:
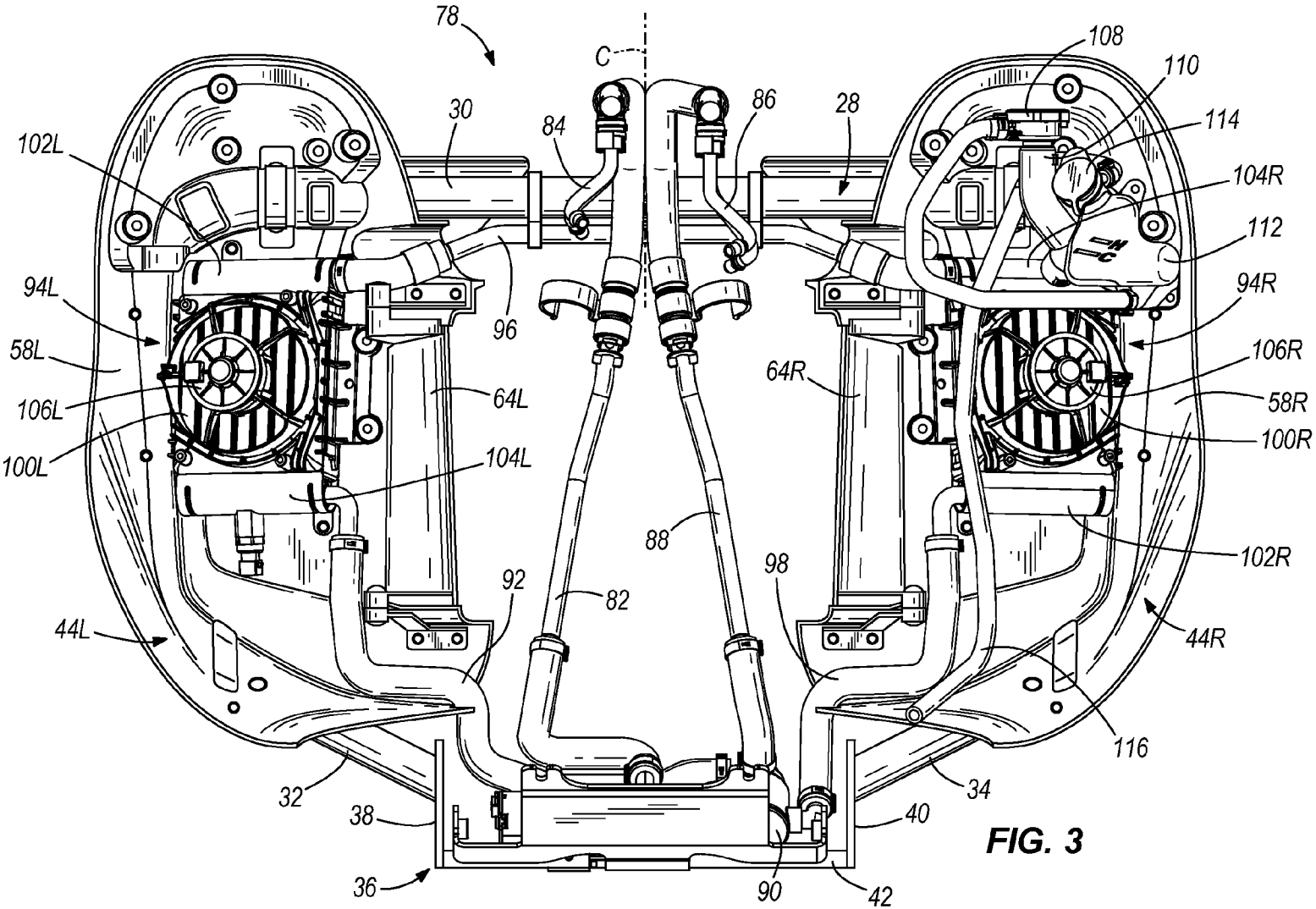
FIG. 3 is a rear view of the portion of the motorcycle of FIG. 2, illustrating a liquid cooling circuit, including radiator assemblies positioned within the right and left lowers.

With additional reference to FIGS. 2 and 3, the frame 12 includes a steering head 24 and two down tubes 26 extending downwardly from the steering head 24 at the front end of the frame 12. The motorcycle 10 includes an engine guard 28 coupled to down tubes 26. The engine guard 28 includes a top bar 30, a left side bar 32, a right side bar 34, and a lower portion 36. The lower portion 36 includes a left flange 38 at the lowermost end of the left side bar 32, a right flange 40 at the lowermost end of the right side bar 34, and a connecting portion 42 between the right and left flanges 38, 40. The top bar 30 is connected to an upper portion of the down tubes 26 and the left and right flanges 38, 40 are connected to lower portions of the down tubes 26 (e.g., at the location where the foot pegs or foot controls are mounted to the frame 12). The engine guard 28 protects the engine 20 of the motorcycle 10 from contacting the ground in the event that the motorcycle 10 is tipped over.

The motorcycle 10 includes left and right lower side fairings (or "lowers") 44L, 44R coupled to the engine guard 28 such that each of the lowers 44L, 44R is located on a respective side of a central plane C of the motorcycle 10. As used herein, each reference number including an "L" identifies structure positioned on the left side of the motorcycle 10 (from the perspective of a rider seated on the motorcycle 10) and each corresponding reference number including an "R" identifies structure positioned on the right side of the motorcycle 10. The lowers 44L, 44R are positioned generally in front of the area occupied by a rider's legs and assist in blocking wind from the rider's shins and feet when riding. Each lower 44L, 44R includes a forward panel 170L, 170R having a top portion 46L, 46R, an outboard portion 48L, 48R, an inboard portion 50L, 50R, a lower portion 52L, 52R, and a central portion 54L, 54R (FIG. 2). Also, each forward panel 170L, 170R includes a forward facing surface 56L, 56R and a rearward facing surface 58L, 58R. Each forward panel 170L, 170R is generally concave such that the rear facing surface 58L, 58R defines a cavity 174L, 174R (FIG. 3). Each central portion 54L, 54R includes an aperture 60L, 60R covered by a screen 62L, 62R. Each inboard portion 50L, 50R includes a vent 64L, 64R that pivots about a substantially vertical axis allowing the rider to adjust the vent 64L, 64R to direct and control the magnitude of the air passing between the lowers 44L, 44R.

The left and right lowers 44L, 44R are substantially identical mirror images of each other. The attachment of the right lower 44R to the right side of the engine guard 28 will be described in detail. The attachment of the left lower 44L to the left side of the engine guard 28 will not be described, but is attached in a similar manner as the right lower 44R. The forward facing surface 56R of the right lower 44R along the outboard portion 48R includes a contoured surface that forms a recess that receives the right side bar 34. In addition, the top portion 46R includes a contoured surface that forms a recess that receives a portion of the top bar 30. The right lower 44R also includes a top portion cover 66R that fastens to the top portion 46R and captures the portion of the top bar 30 between the contoured surface of the top portion 46R and the top portion cover 66R. The configuration of the right lower 44R allows the right lower 44R to nest into the right side of the engine guard 28. In addition to this, the right lower 44R is attached to the engine guard 28 with U-shaped bolts and straps at various locations.

Figure 4:
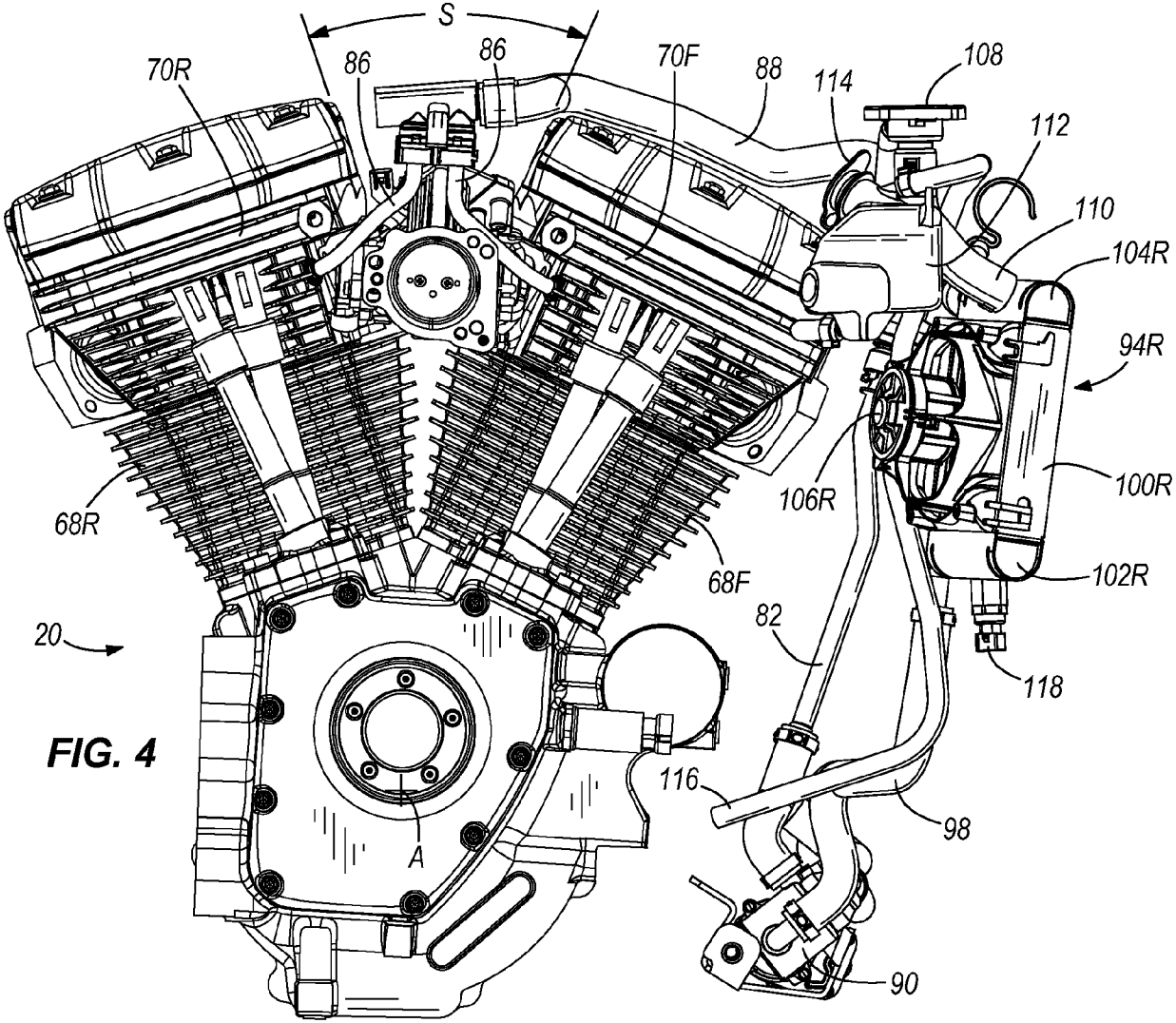
FIG. 4 is a side view of the liquid cooling circuit and an engine of the motorcycle of FIG. 1 with the leg shields removed.
Figure 10A:
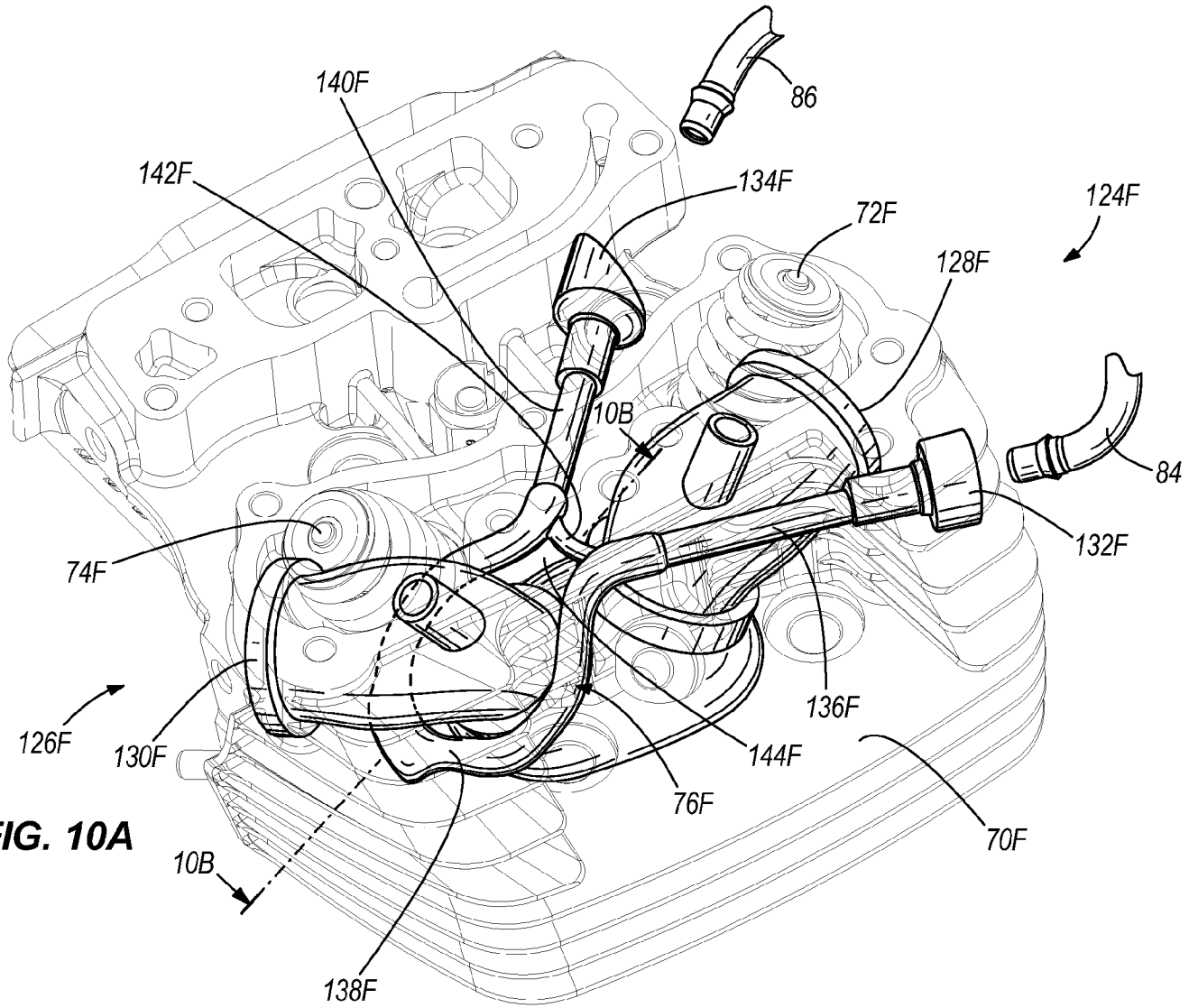
FIG. 10A is a perspective view of the front cylinder head of FIG. 8, illustrating a liquid cooling passage.

FIG. 4 illustrates the engine 20, which is a V-type internal combustion engine including front and rear cylinders 68F, 68R and corresponding front and rear cylinder heads 70F, 70R. As used herein, each reference number including an "F" identifies structure relating to the front cylinder 68F and front cylinder head 70F and each corresponding reference number including an "R" identifies structure relating to the rear cylinder 68R and rear cylinder head 70R. Each cylinder 68F, 68R contains a reciprocating piston (not shown), and each of the cylinder heads 70F, 70R includes an intake valve 72F, 72R and an exhaust valve 74F, 74R for controlling the flow of intake and exhaust air through respective combustion chambers (FIG. 10A). The cylinders 68F, 68R (and the pistons therein) converge toward a crankshaft axis A at a lower portion of the engine 20, creating a space S between the cylinders 68F, 68R and between the cylinder heads 70F, 70R that is increasingly larger in an upward direction. The cylinders 68F, 68R include cooling fins and are air cooled. The cylinder heads 70F, 70R include air cooling fins and internal liquid cooling passages 76F, 76R, which will be described in greater detail below.

The motorcycle 10 includes a liquid cooling system 78 that circulates a liquid through the liquid cooling passages 76F, 76R of the cylinder heads 70F, 70R to remove combustion heat from the cylinder heads 70F, 70R. The liquid cooling system 78, or liquid cooling circuit, which is best illustrated in FIGS. 4-7, includes a pump 80, a supply header 82, a pair of supply branch lines 84, the liquid cooling passages 76F, 76R, a pair of return branch lines 86, a return header 88, and a thermostat valve 90 all connected in series. The liquid cooling system 78 also includes a radiator supply line 92, a right radiator assembly 94R, a radiator crossover line 96, a left radiator assembly 94L, and a radiator return line 98, which are all also connected in series with the thermostat valve 90.

Each radiator assembly 94L, 94R includes radiator coil 100L, 100R, a discharge manifold 102L, 102R defining a cool side of the radiator coil 100L, 100R, and an inlet manifold 104L, 104R defining a warm side of the radiator coil 100L, 100R, and a fan 106L, 106R adjacent the rearward surface of the radiator coil 100L, 100R. The radiator assemblies 94L, 94R are coupled to the respective lowers 44L, 44R. Specifically, the right radiator assembly 94R is positioned within the cavity 174R of the right lower 44R and covers the aperture 60R from the rearwardly facing side of the right lower 44R. The left radiator assembly 94L is positioned within the cavity 174L of the left lower 44L and covers the aperture 60L from the rearwardly facing side of the left lower 44L. The radiator assemblies 94L, 94R are attached to the lowers 44L, 44R with threaded fasteners that are threadingly engaged with mounting bosses on the lowers 44L, 44R.

Figure 5:
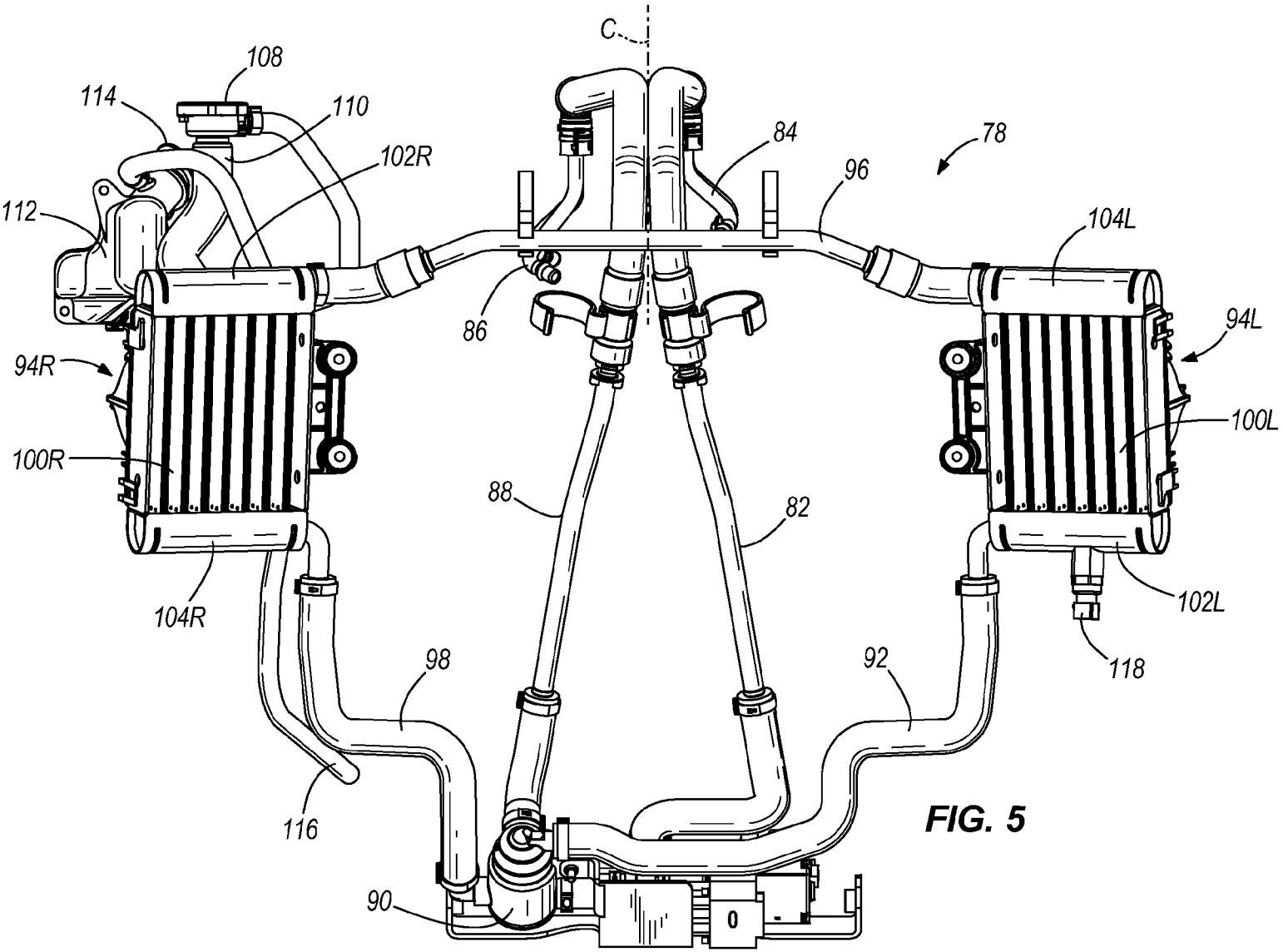
FIG. 5 is a front view of the liquid cooling circuit of FIG. 4 with the engine removed.
Figure 6:
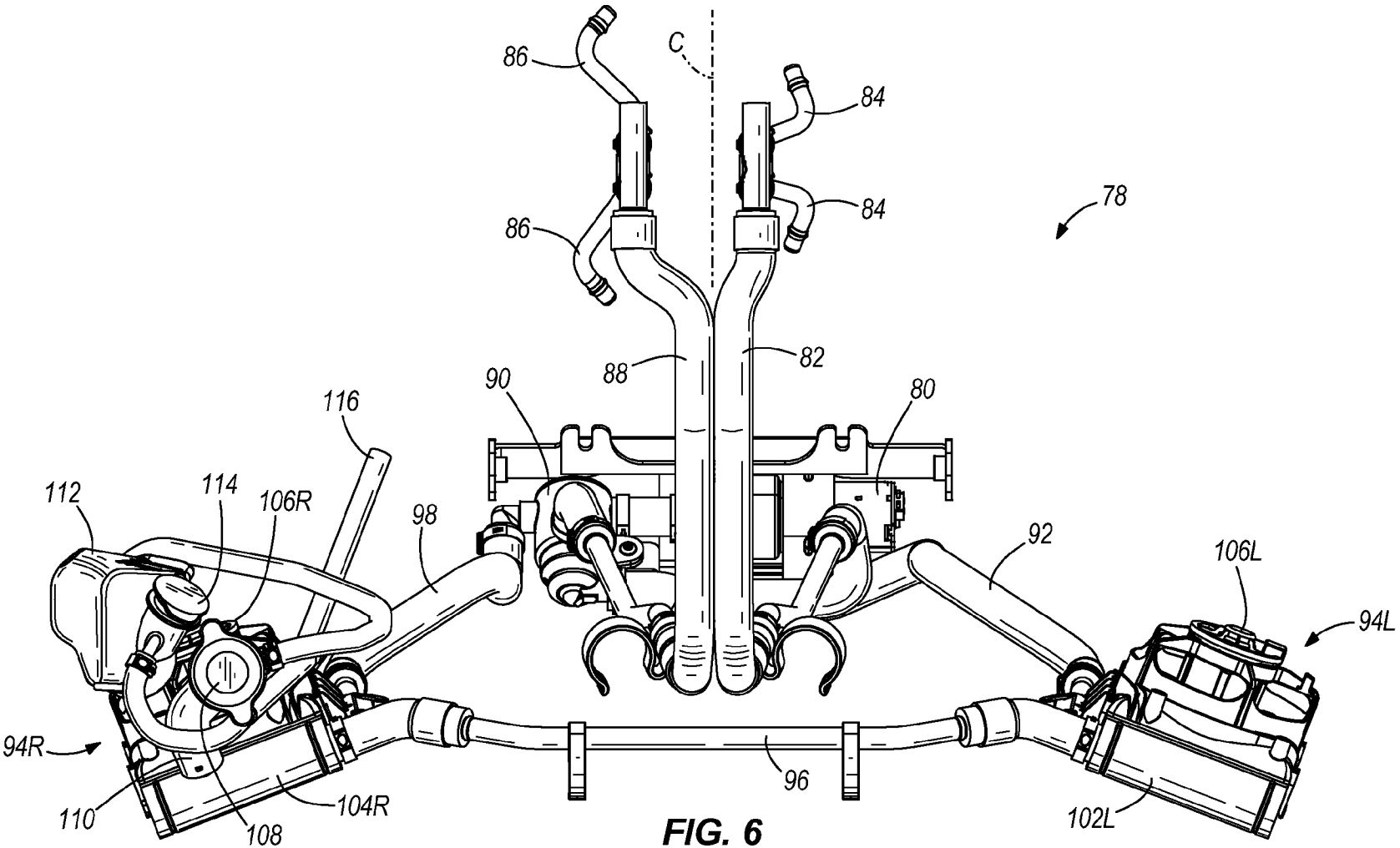
FIG. 6 is a top view of the liquid cooling circuit of FIG. 5.
Figure 7:
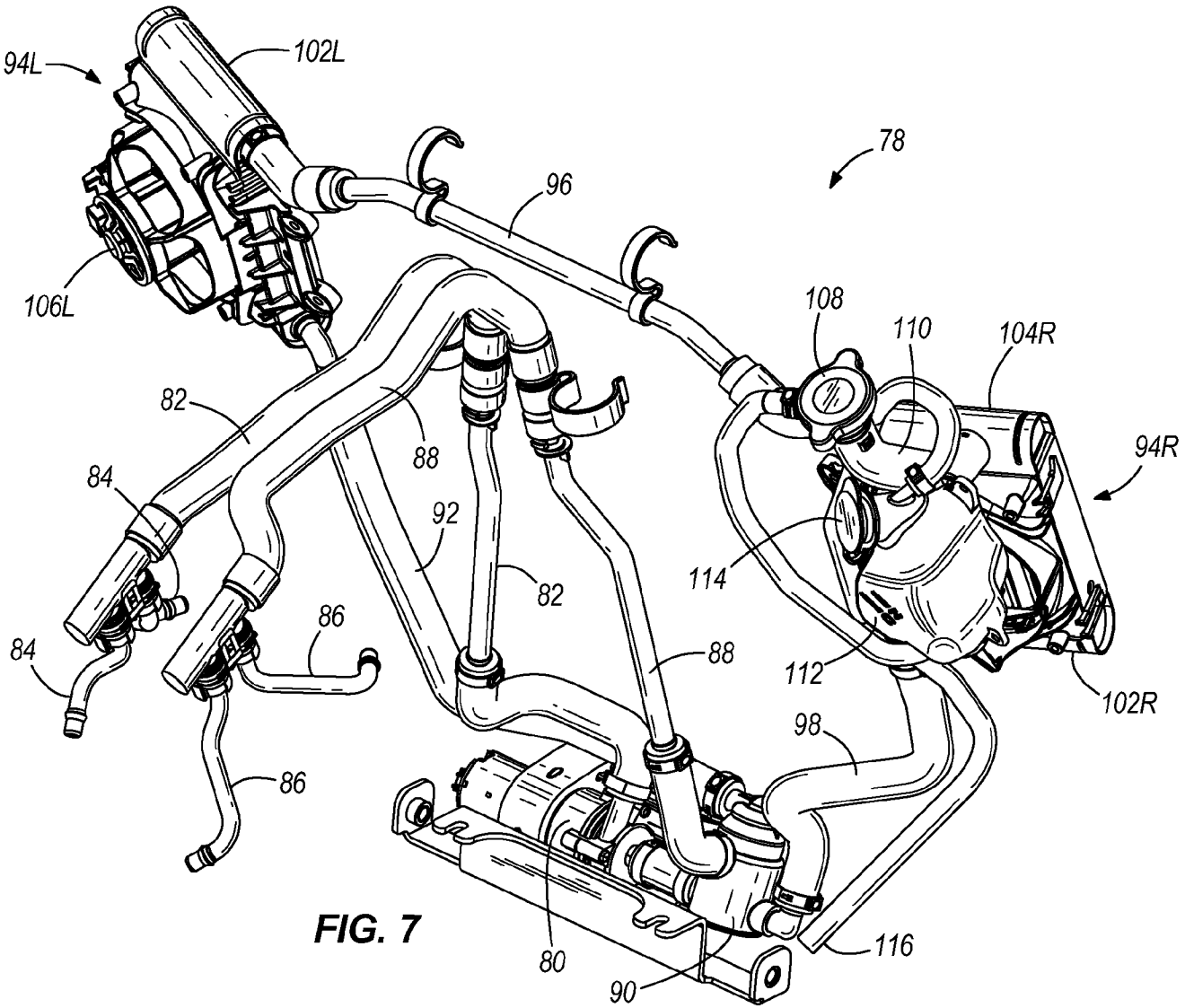
FIG. 7 is a perspective view of the liquid cooling circuit of FIG. 5.

The pump 80 and thermostat valve 90 are coupled to and supported by the lower portion 36 of the engine guard 28. The pump 80 is positioned between the left and right lowers 44L, 44R at an elevation substantially lower than the left and right radiator coils 100L, 100R when the motorcycle 10 is in an upright position (FIG. 5). The pair of supply branch lines 84 and the pair of return branch lines 86 are located substantially entirely within the space S of the V-twin engine 20 (FIG. 4).

The liquid cooling system 78 also includes a pressure cap 108 and fill neck 110 in fluid communication with the inlet manifold 104R of the right radiator assembly 94R, an overflow bottle 112 and fill cap 114 in fluid communication with the pressure cap 108, and an overflow tube 116 in fluid communication with the overflow bottle 112 and the atmosphere. The liquid cooling system 78 also includes a drain plug 118 on the inlet manifold 104L of the left radiator assembly 94L.

Figure 11:
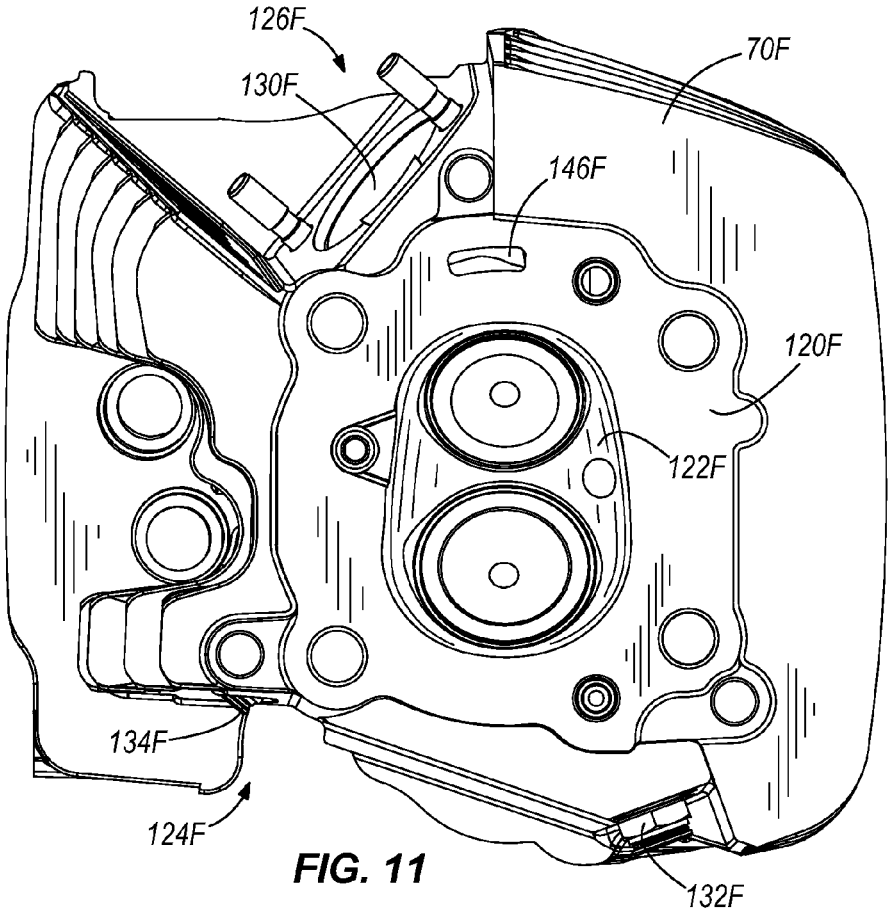
FIG. 11 is a bottom view of the front cylinder head of FIG. 8, illustrating an opening exposed on a base of the front cylinder head.

FIGS. 8-11 illustrate the front cylinder head 70F. The rear cylinder head 70R is substantially identical to the illustrated forward cylinder head 70F with the exception of being a mirror-image thereof. The cylinder head 70F includes a base 120F configured to face the corresponding cylinder 68F of the engine 20 and to be coupled thereto to define a combustion chamber 122F (FIG. 11). The cylinder head 70F further includes an intake side 124F and an exhaust side 126F. The intake side 124F includes an intake passage 128F and the intake valve 72F disposed within the intake passage 128F and movable therein. The exhaust side 126F of the head 70F includes an exhaust passage 130F and the exhaust valve 74F disposed within the exhaust passage 130F and movable therein. The intake valve 72F selectively provides intake air from the intake passage 128F into the combustion chamber 122F, and the exhaust valve 74F selectively releases combustion exhaust gases from the combustion chamber 122F to the exhaust passage 130F. Heat from the combustion process tends to heat the cylinder head 70F, especially in the areas around the combustion chamber 122F and the exhaust passage 130F.

As best shown in FIG. 10A, the liquid cooling passage 76F extends through the cylinder head 70F from an inlet port 132F to a discharge port 134F. The cooling passage 76F extends in a single loop from the inlet port 132F on the intake side 124F of the head 70F toward and around the exhaust passage 130F and back to the discharge port 134F on the intake side 124F of the head 70F. Liquid is not routed into or through the cylinders 68F, 68R whatsoever. Thus, only the cylinder heads 70F, 70R of the engine 20 are directly cooled by the liquid, while the cylinders 68F, 68R are strictly cooled by air. Furthermore, the cylinder heads 70F, 70R are designed to be precision cooled to specifically target the area around the exhaust passages 130L, 130R. The cooling passage 76F primarily extends around the exhaust passage 130F, rather than extending throughout the entire cylinder head 70F. The cooling passage 76F has a focused path and defines a measurable length through which the liquid flows. In other words, the cooling passage 76F is formed by conduits having generally symmetrical cross-sections such that the conduits in combination define a longitudinal axis (not shown) that follows the center of the cooling passage 76F such that the length of the longitudinal axis can be measured. This is in contrast to cooling passages of the prior art that are defined by free-form-shaped cavities that do not intuitively define a longitudinal axis, path, or length.

Referring again to FIGS. 8-11, the inlet and discharge ports 132F, 134F are positioned on the intake side 124F of the cylinder head 70F. The inlet and discharge ports 132F, 134F are visible on the cylinder head 70F from an orthogonal view looking forwardly from the rear of the motorcycle 10 (FIG. 9) (or conversely the inlet and discharge ports 132F, 134F are visible on the rear cylinder head 70R from an orthogonal view looking rearwardly from the front of the motorcycle 10). The inlet and discharge ports 132F, 134L of the front cylinder head 70F each define a port axis (not shown) that exits the port in a rearward direction, and the inlet and discharge ports 132R, 134R of the rear cylinder head 70R each define a port axis (not shown) that exits the port in a forward direction. The inlet and discharge ports 132F, 134F are spaced apart from a plane P defined by the base of the cylinder head 70F. The inlet and discharge ports 132F, 134F are positioned on opposite sides of the intake passage 128F.

Figure 10B:
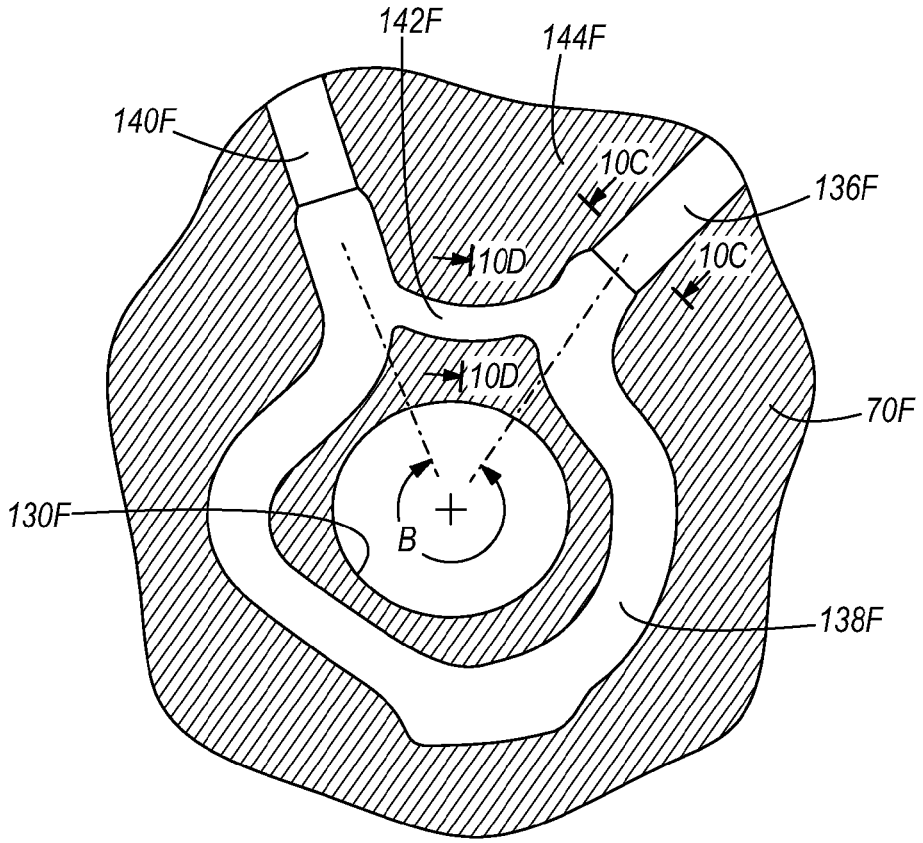
FIG. 10B is a cross-section view taken along line 10B-10B in FIG. 10A, illustrating a portion of the liquid cooling passage encircling an exhaust passage of the front cylinder head.
Figure 10C:
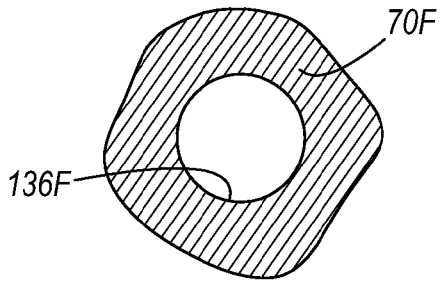
FIG. 10C is a cross-section taken along line 10C-10C in FIG. 10B, illustrating a substantially circular cross-section of a straight portion of the liquid cooling passage.
Figure 10D:
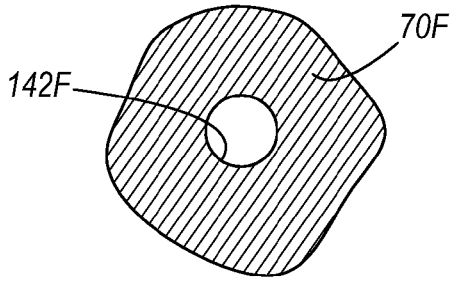
FIG. 10D is a cross-section taken along line 10D-10D in FIG. 10B, illustrating a substantially circular cross-section of a connecting section of the liquid cooling passage.

As shown in FIGS. 10A and 10B, the cooling passage 76F includes a first substantially straight portion 136F extending into the cylinder head 70F from the inlet port 132F, a generally horseshoe-shaped portion 138F that extends from the end of the first straight portion 136F and generally follows the curvature of the exhaust passage 130F for at least an angle B (e.g., 270 degrees of rotation) to substantially circumscribe the exhaust passage 130F, and a second straight portion 140F that extends from the end of the horseshoe-shaped portion 138F along a straight path to connect to the discharge port 134F. A connecting section 142F fluidly connects the interconnections of the first straight portion 136F and the second straight portion 140F with the horseshoe-shaped portions 138F. The connecting section 142F passes through a bridge portion 144F of the cylinder head 70F between the intake passage 128F and the exhaust passage 130F, and the connecting section 142F has a reduced diameter compared to the rest of the cooling passage 76F (FIGS. 10C and 10D). The liquid cooling passage 76F has a substantially circular cross-section along substantially its entire length.

Figure 8:
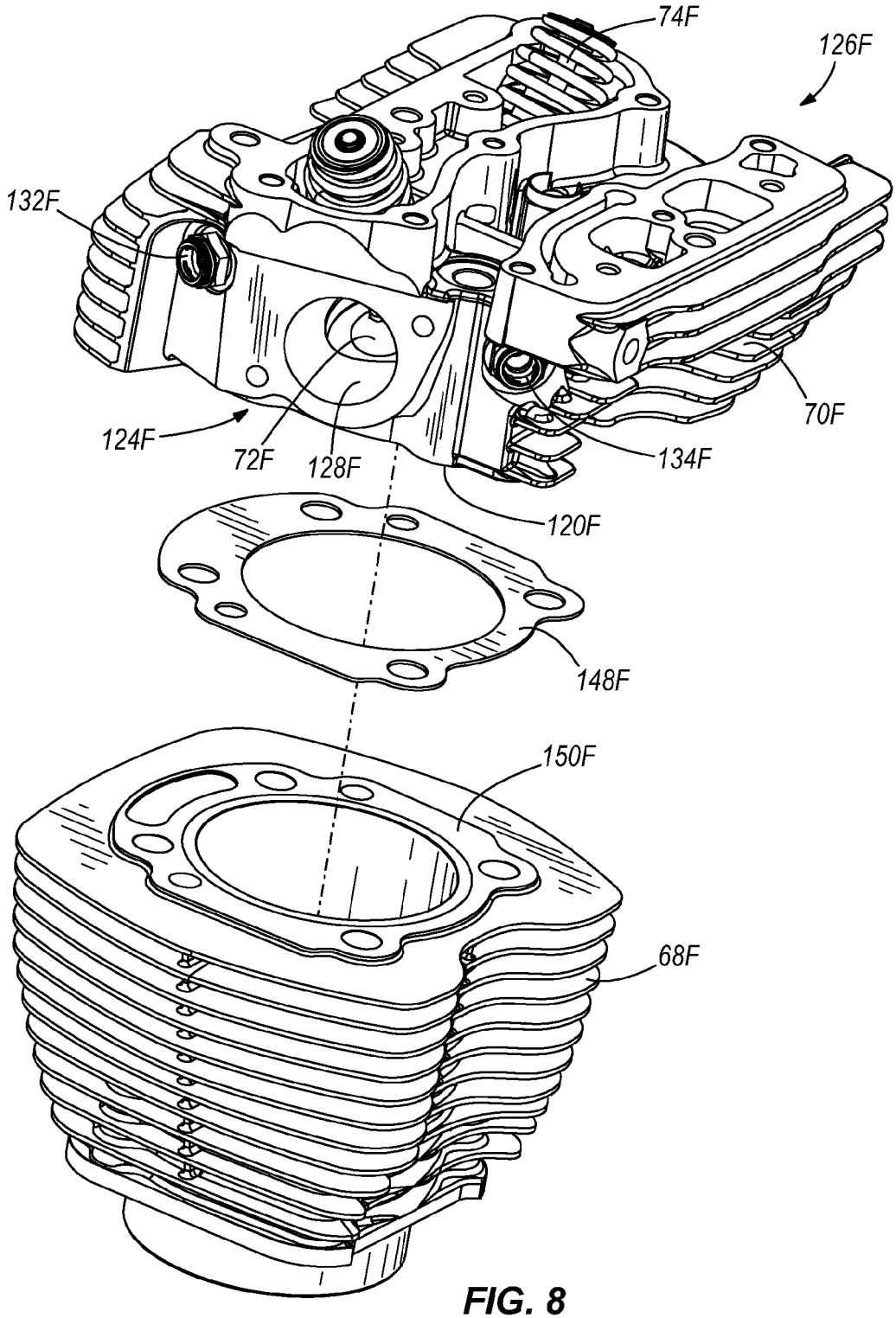
FIG. 8 is an exploded perspective view of a portion of the engine of FIG. 4, illustrating a front cylinder, a front gasket, and a front cylinder head.
Figure 9:
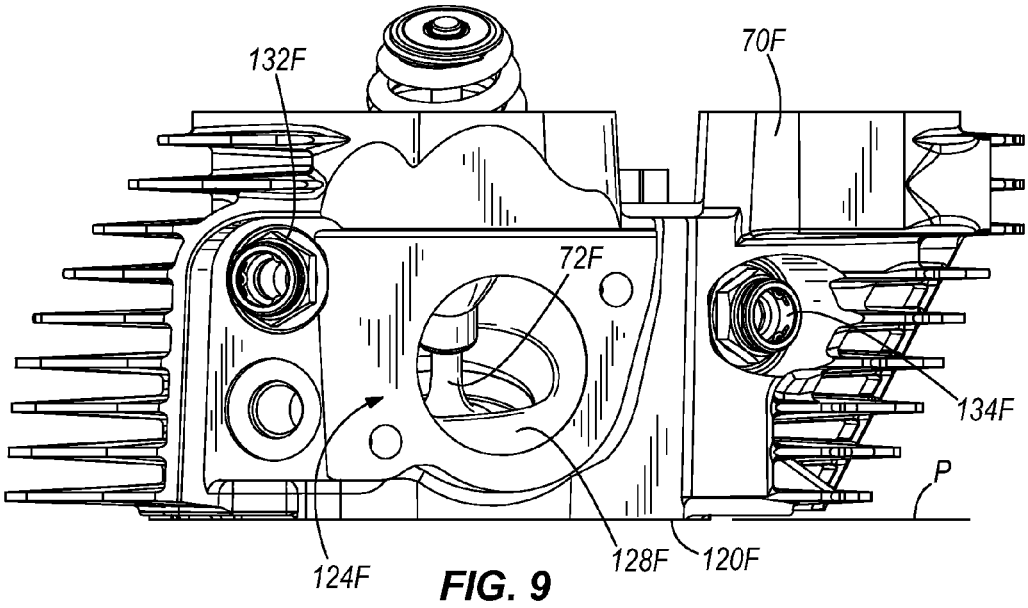
FIG. 9 is a rear view of the front cylinder head of FIG. 8, illustrating an intake side of the front cylinder head.

As illustrated in FIGS. 8 and 11, a middle portion of the horseshoe-shaped portion 138F breaks the surface of the base 120F to define an opening 146F that exposes a portion of the liquid cooling passage 76F. The opening 146F is covered by a gasket 148F sandwiched between the base 120F of the cylinder head 70F and a deck 150F of the cylinder 68F when the engine 20 is assembled. The gasket 148F inhibits leakage of the cooling fluid from the opening 146F.

Figure 12:
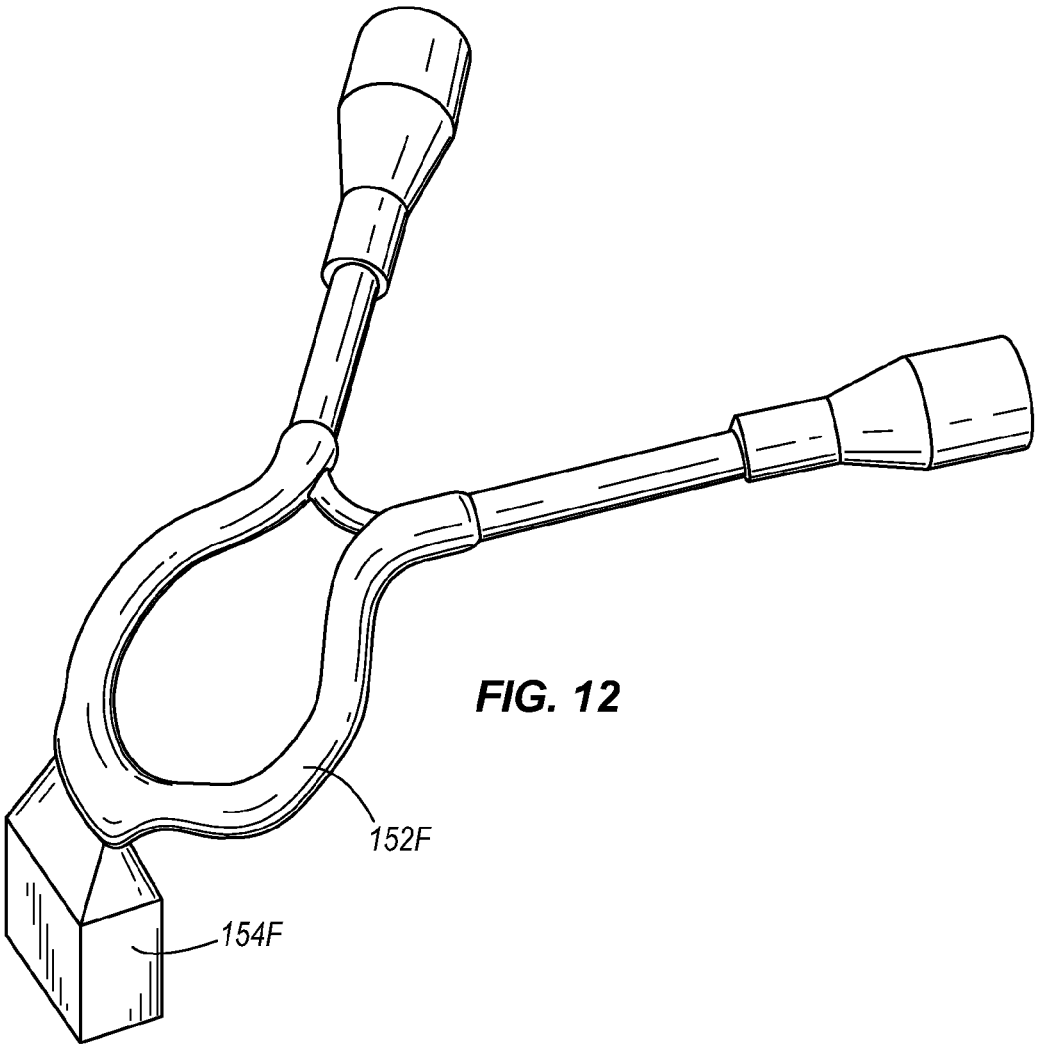
FIG. 12 is a perspective view of a core used in the manufacture of the front cylinder head and liquid cooling passage of FIG. 10A.

With reference to FIGS. 10A and 12, the cylinder head 70F is manufactured by a casting process that utilizes cores to define and form interior passages such as the intake and exhaust passages 128F, 130F. In addition, a core 152F (FIG. 12A) is used to form the cooling passage 76F. The core 152F includes feet that are secured in the casting block or tooling such that the core remains stationary during the casting and cooling process. The core includes three feet. The first and second feet are located on the ends of the straight portions and the third foot 154F is located at the base of the horseshoe-shaped portion 138F. The third foot 154F creates the opening 146F during the casting process. After the cylinder head 70F is cast, the cores are removed with water or chemicals.

As shown in FIGS. 5-7, 13, and 14, the coolant supply header 82 extends from the pump 80 to the space S between the cylinders 68F, 68R. The coolant supply header 82 splits into the pair of supply branch lines 84 that connect the cooling passages 76F, 76R of the cylinder heads 70F, 70R into the liquid cooling system 78. The discharge ports 134F, 134R provide liquid coolant from the cylinder heads 70F, 70R to the pair of return lines 86 that both flow into the coolant return header 88. All of the inlet ports and discharge ports 132F, 132R, 134F, 134R on the cylinder heads 70F, 70R are provided with quick-connect fittings for connecting to and/or disconnecting from the supply branch lines 84 and the return branch lines 86 without the use of tools. Because the inlet ports 132F, 132R and the discharge ports 134F, 134R are all located adjacent the space S (inside the "V" of the engine 20, shown in FIG. 4), the supply and return headers 82, 86 need only be routed to a single location. Stated another way, the inlet and discharge ports 132F, 132R, 134F, 134R are located on the intake sides 124F, 124R, which are positioned adjacent the space S.

Figure 13:
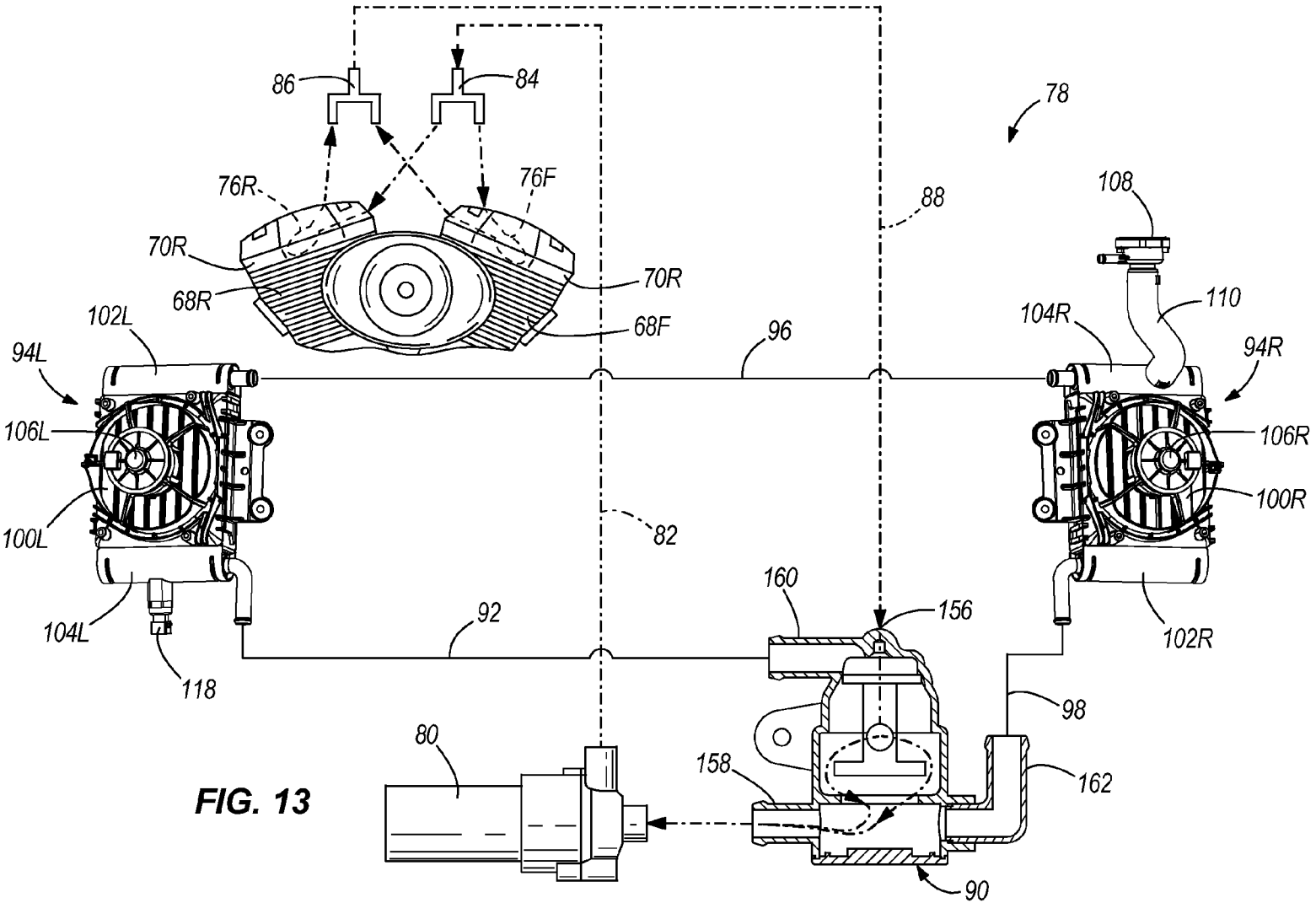
FIG. 13 is a schematic view of the liquid cooling circuit of FIG. 5, illustrating a first state of operation in which liquid coolant bypasses radiator coils of the radiator assemblies.

During operation, the cooling system 78 operates to circulate a liquid through the cylinder heads 70F, 70R to cool the cylinder heads 70F, 70R. As shown in FIG. 13, in a first mode of operation when the temperature of the liquid is below a threshold temperature, the pump 80 circulates the liquid through the supply header 82, through the supply branch lines 84, through the cooling passages 76F, 76R, through the return branch lines 86, through the return header 88, and into a first valve inlet 156 of the thermostat valve 90. Due to the temperature of the liquid being below the threshold temperature, the valve 90 is in a first position to allow the liquid to flow through the valve 90 out a first valve outlet 158 to return to the pump 80. In the first mode, the thermostat bypasses the right and left radiator assemblies.

Figure 14:
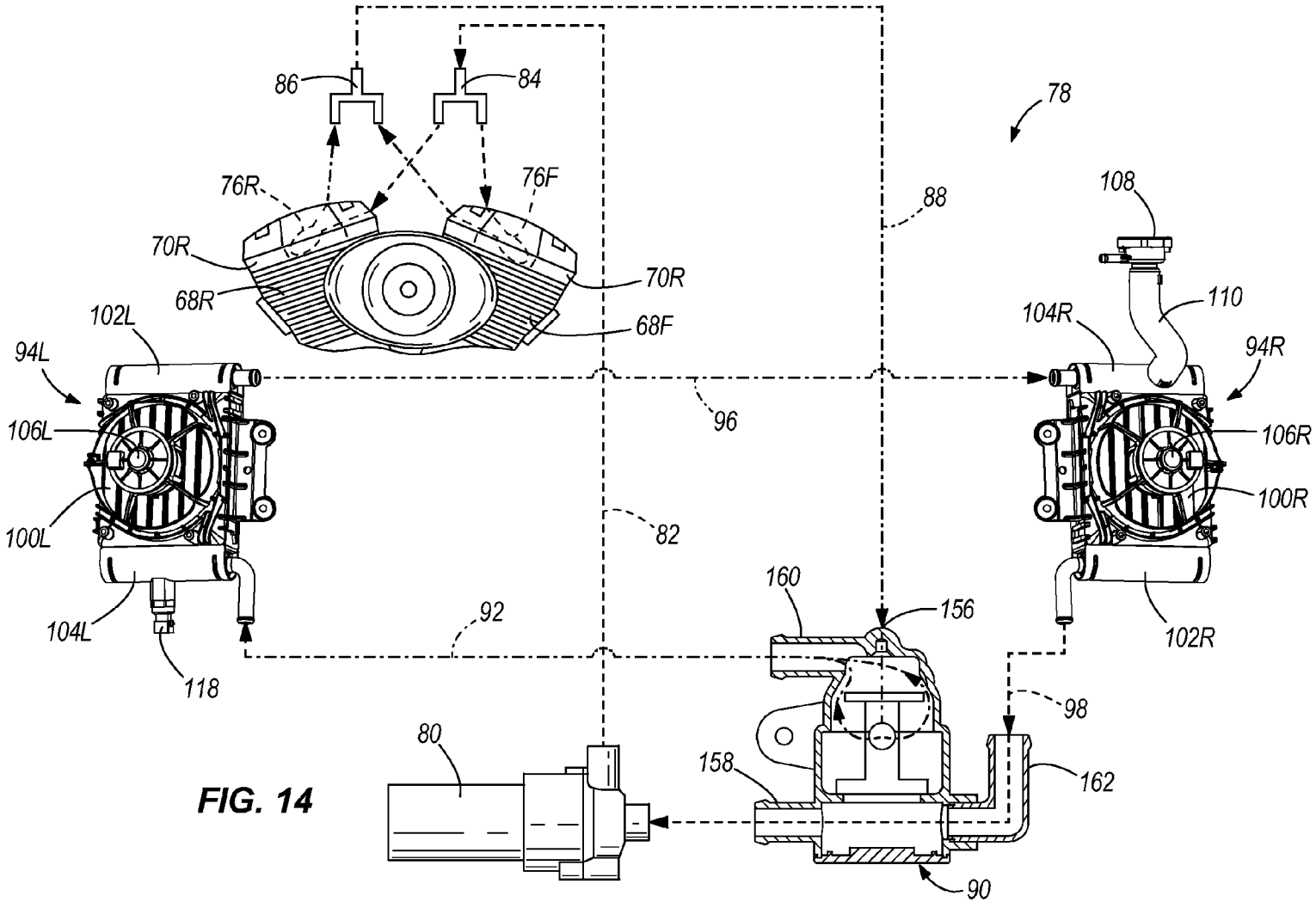
FIG. 14 is a schematic view similar to FIG. 13, illustrating a second state of operation in which liquid coolant flows through the radiator coils.

A second mode of operation is illustrated in FIG. 14. This mode of operation occurs when the temperature of the liquid is at or above a threshold temperature. In the second mode, the pump 80 circulates the liquid through the supply header 82, through the supply branch lines 84, through the cooling passages 76F, 76R, through the return branch lines 86 through the return header 88, and into the first valve inlet 156 of the thermostat valve 90. Due to the temperature of the liquid being at or above the threshold temperature, the valve 90 is in a second position to allow the liquid to flow through the valve 90 and out a second valve outlet 160. From the second valve outlet 160, the fluid is directed through the radiator supply line 92, the inlet manifold 104R, radiator coil 100R, and discharge manifold 102R of the right radiator assembly 94R, through the radiator cross-over line 96, through the inlet manifold 104L, radiator coil 100L, and discharge manifold 102L of the left radiator assembly 94L, and back to a second valve inlet 162 of the thermostat valve 90. The second valve inlet 162 directs the liquid to the first valve outlet 158 which leads back to the pump 80. In the second mode of operation, the fans 160L, 160R are rotated to draw air through the radiator coils 100L, 100R to assist in transferring heat from the liquid in the radiator coils 100L, 100R to the air passing through.

Figure 15:
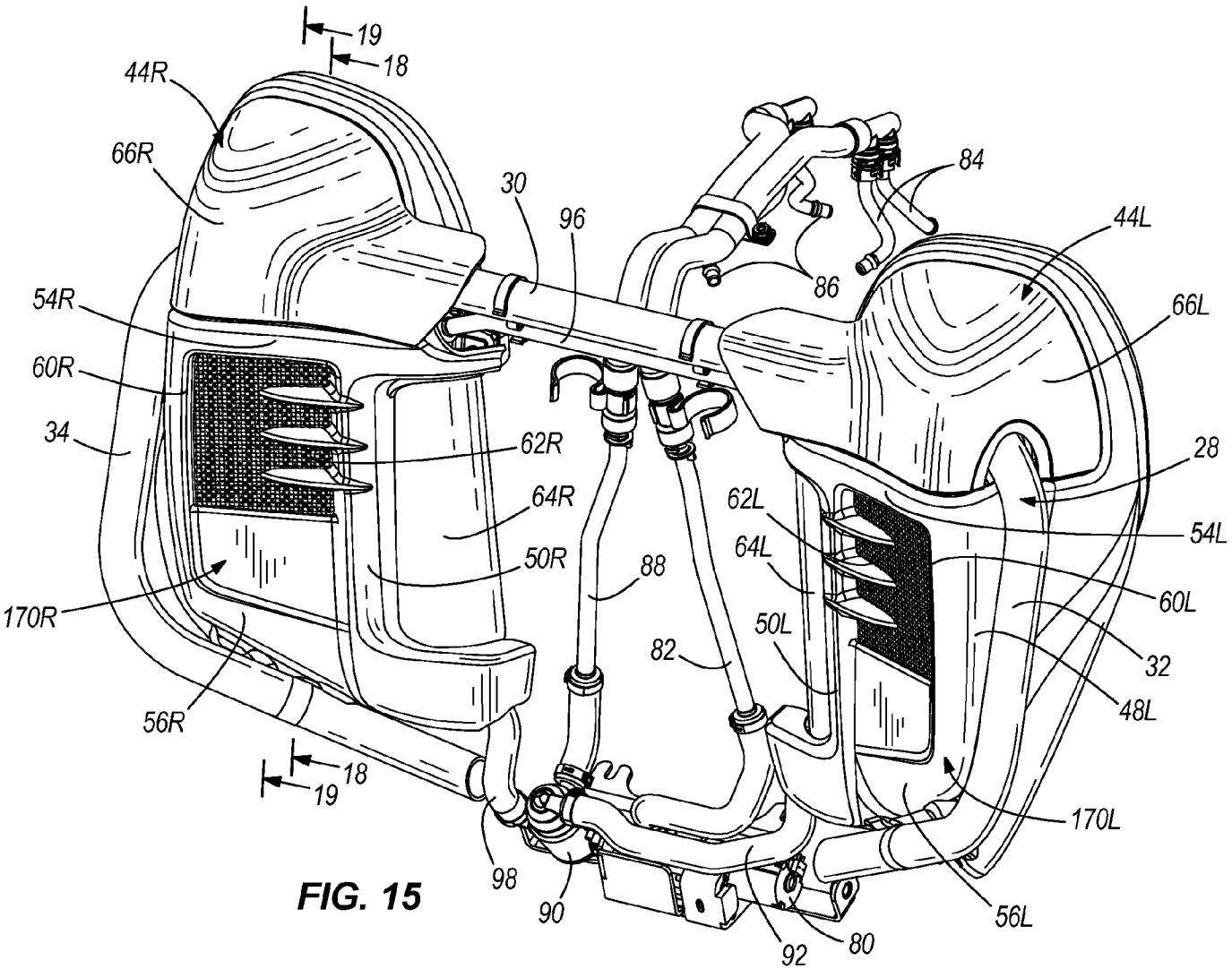
FIG. 15 is a front perspective view of the portion of the motorcycle of FIG. 2, illustrating the left and right lowers.
Figure 16:
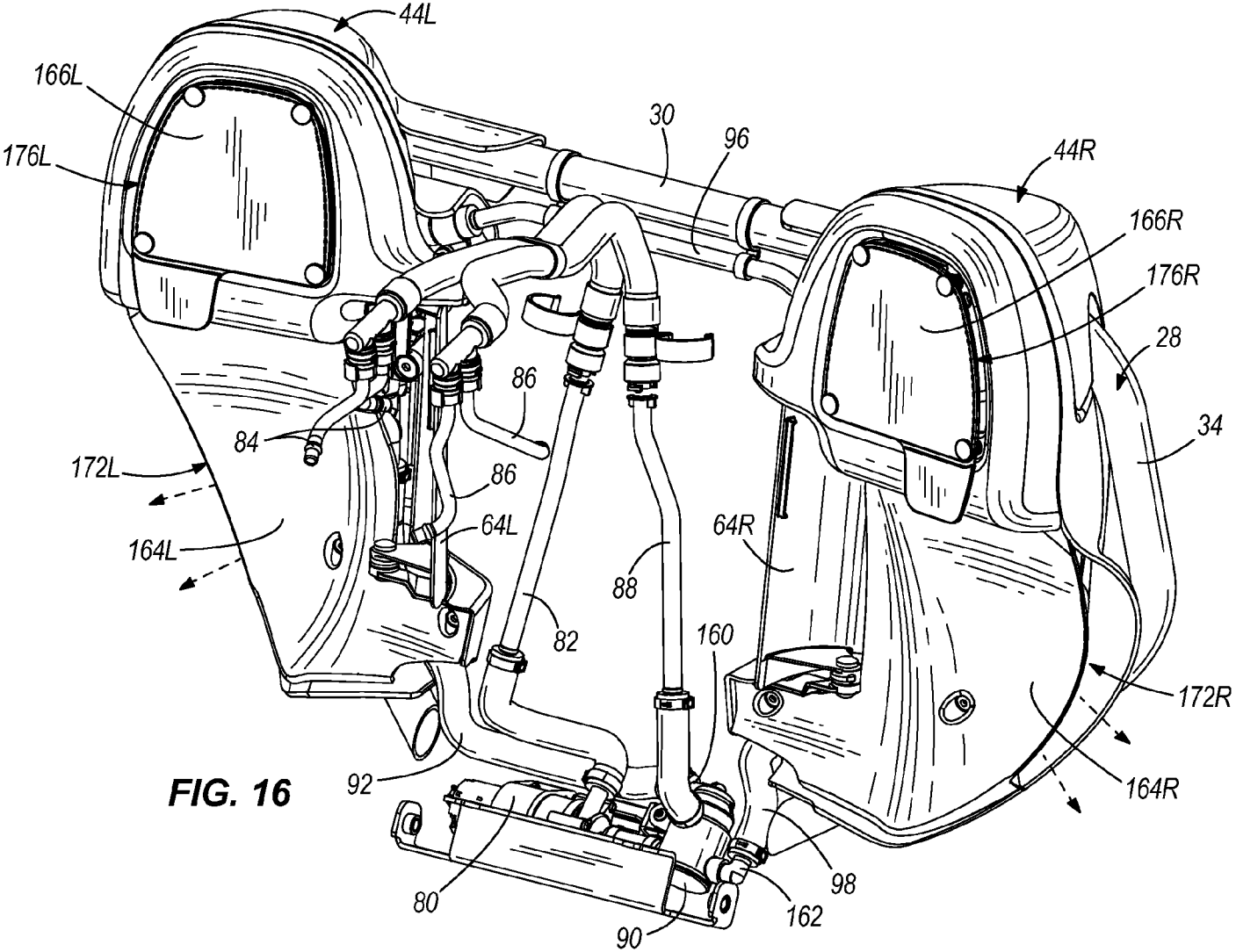
FIG. 16 is a rear perspective view of the left and right lowers of FIG. 15.
Figure 17:
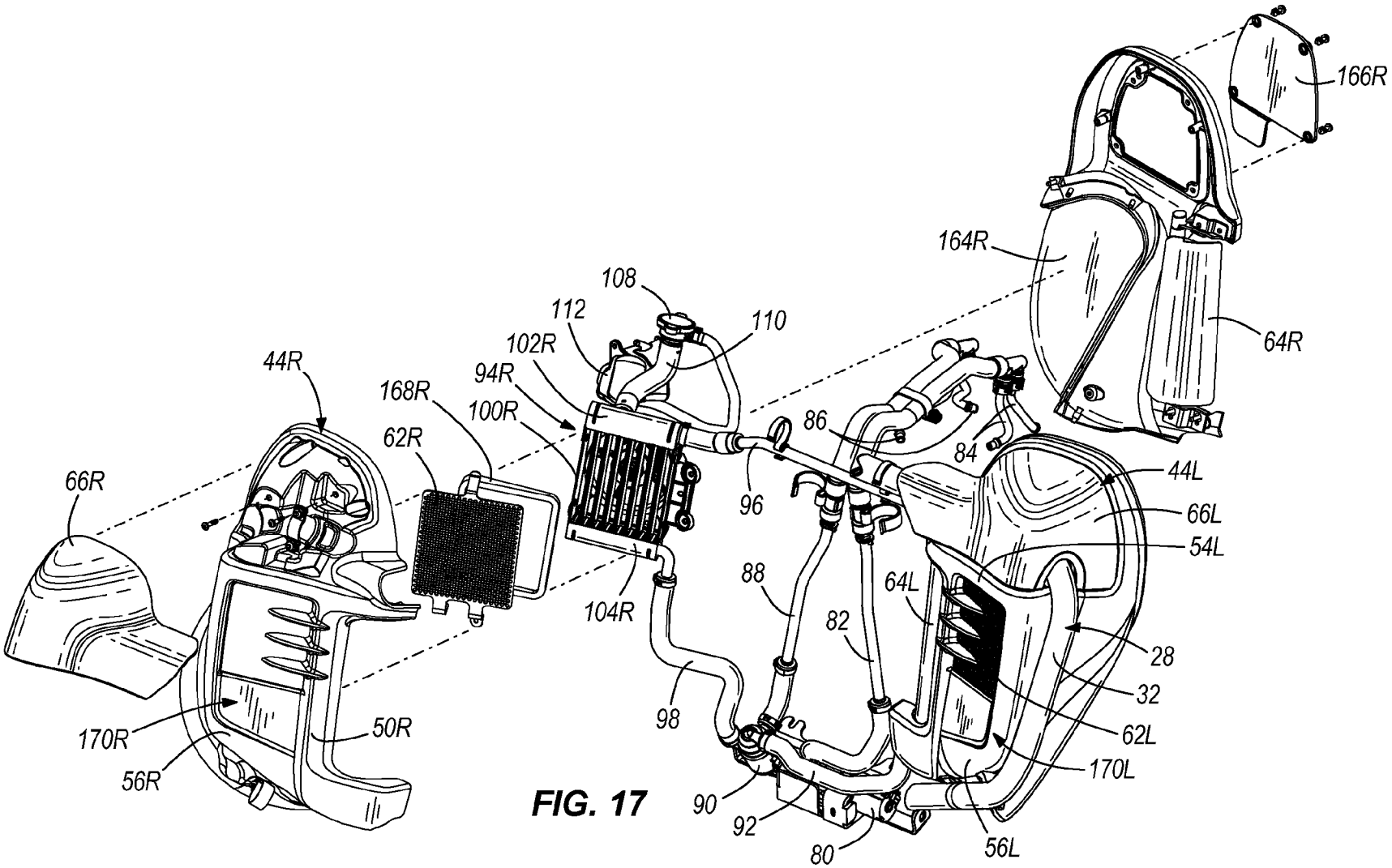
FIG. 17 is an exploded view of the right lower of FIG. 15.

With reference to FIGS. 15-17, the lowers 44L, 44R include rear panels 164L, 164R that are coupled to the forward panels 170L, 170R such that the rearward facing surfaces 58L, 58R of the forward panels 170L, 170R are covered to define cavities 174L, 174R that house the radiator assemblies 94L, 94R. In addition, the rear panels 164L, 164R include storage covers 166L, 166R that cover and selectively provide access to storage cavities 176L, 176R within the lowers 44L, 44R. The storage cavities 176L, 176R are positioned above and sealed off from the cavities 174L, 174R. The rear panels 164L, 164R also define ducts 172L, 172R for air exiting the radiator assemblies 94L, 94R. The ducts 172L, 172R direct air away in an outboard direction from the motorcycle 10 such that the air is directed downward and away from the motorcycle and the rider's shins. FIG. 17 shows the right rear panel 164R and the right storage cover 166R in relation to the liquid cooling system 78. FIG. 17 also shows adapters 168L, 168R that fit between the left and right screens 62L, 62R and the left and right radiator assemblies 94L, 94R.

Figure 18:
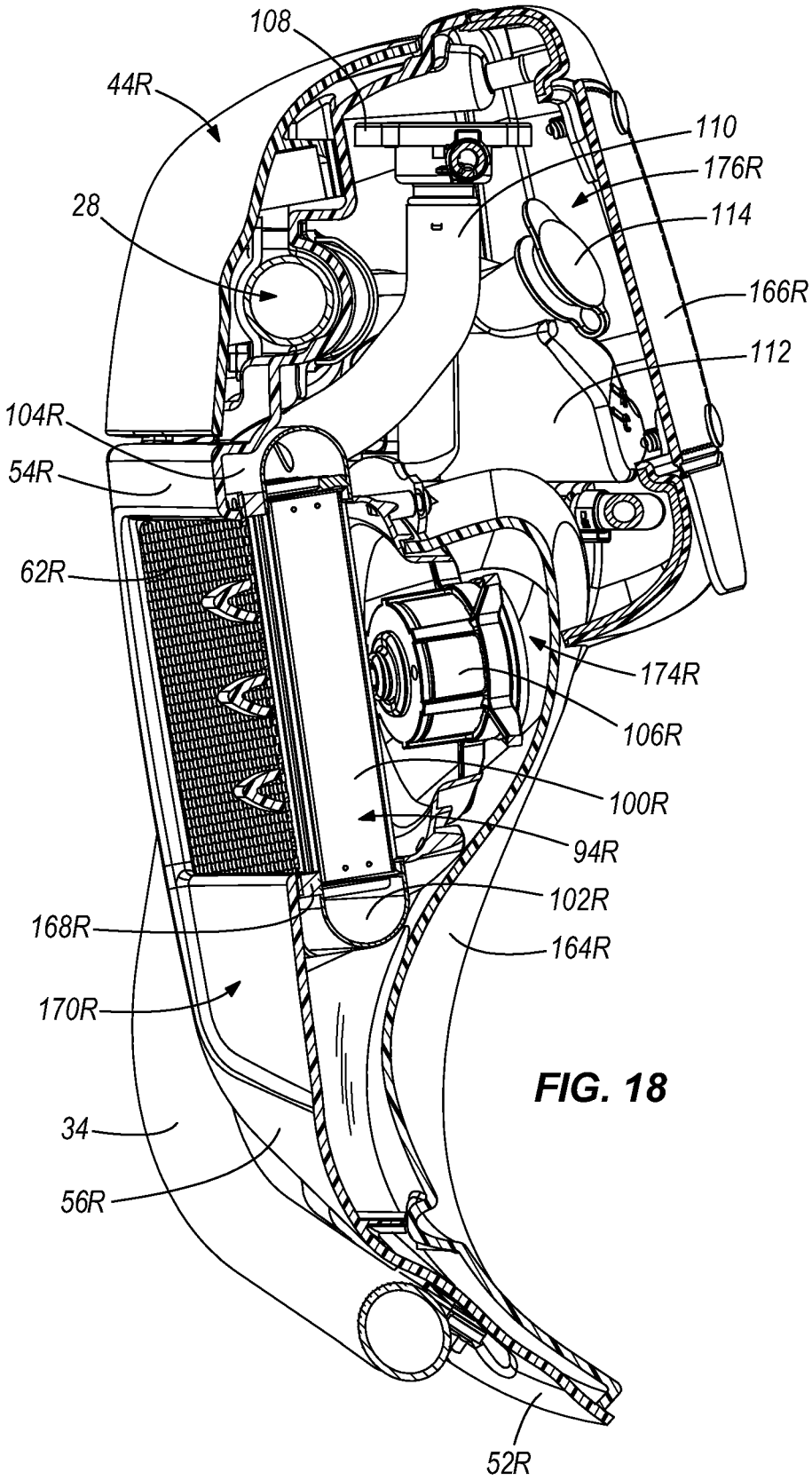
FIG. 18 is a cross-section view taken along line 18-18 in FIG. 15.
Figure 19:
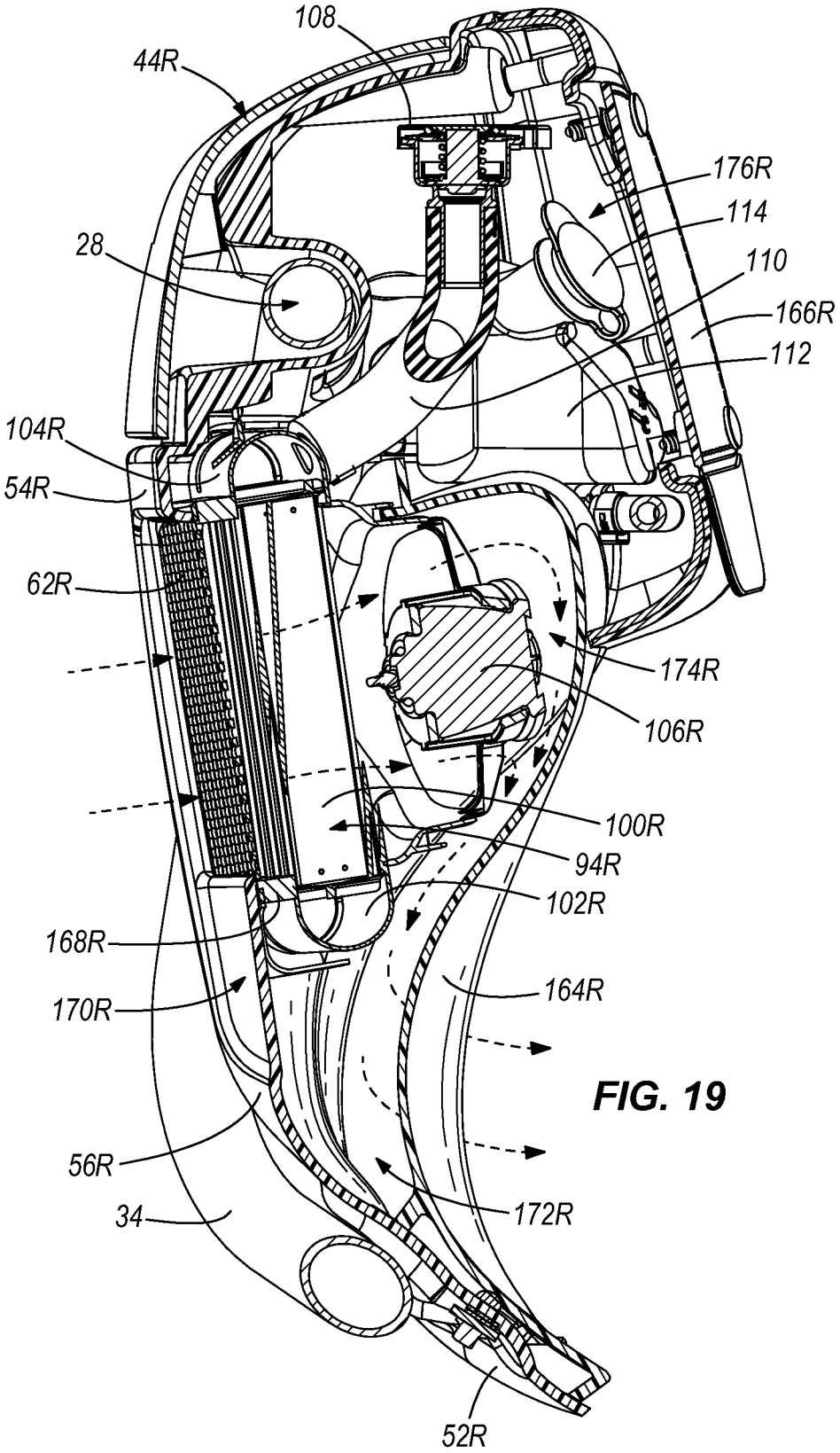
FIG. 19 is a cross-section view taken along line 19-19 in FIG. 15, illustrating the air flow direction through the right lower.

FIGS. 18 and 19 show the arrangement of the right radiator assembly 94R in the cavity 174R formed in the right lower 44R. The arrows illustrated in phantom lines in FIGS. 16 and 19 show more clearly the path that air takes as it passes through the right radiator assembly 94R, enters the cavity 174R, and exits through the duct 172R.

During use, the duct 172R redirects air flow away from rider, discharging air into a low pressure, high velocity air flow location. Duct 172R is designed to minimize restriction to air flow, while maintaining clearance for the rider's leg, foot, and motorcycle controls (e.g., rear brake pedal, shifter lever). The duct 172R is positioned to expel heated air into a relatively low pressure, high velocity flow region of air stream around the vehicle. The duct 172R allows heated air to be carried away from rider by slipstream air flow around bike, with minimal recirculation rearward of the right and left lowers 44L, 44R. The duct also improves air flow performance through the radiator due to a greater pressure differential between the air duct inlet and outlet.

What is claimed is:

1. A motorcycle comprising:

a frame;

an engine having a V-twin configuration coupled to the frame;

right and left engine guards coupled to the frame forwardly of the engine and extending laterally outwardly from the frame;

right and left leg shields coupled to the right and left engine guards, respectively;

a liquid cooling circuit in communication with the engine;

a thermostat valve and a water pump in fluid communication with the liquid cooling circuit;

wherein the liquid cooling circuit further includes a supply header running from the water pump to the engine and a return header running from the engine to the thermostat valve, wherein the liquid cooling circuit includes a pair of supply branch lines running from the supply header to each of a first cylinder head and a second cylinder head of the V-twin engine and a pair of return lines running from the first and second cylinder heads to the return header;

right and left radiators in fluid communication with the liquid cooling circuit and positioned within the right and left leg shields, respectively;

wherein the thermostat valve is configured to selectively bypass at least one of the right and left radiators depending upon a sensed temperature of liquid coolant within the liquid cooling circuit, and wherein the water pump is positioned between the right and left leg shields, at an elevation substantially lower than the right and left radiators when the motorcycle is in an upright position; and wherein the right and left leg shields include a right duct and a left duct, respectively, wherein the right duct is configured to direct air received from the right radiator away from the motorcycle, and wherein the left duct is configured to direct air received from the left radiator away from the motorcycle.

2. The motorcycle of claim 1, wherein the liquid cooling circuit is in fluid communication with one or more cylinder heads of the engine and no other portion of the engine.

3. The motorcycle of claim 2, wherein the liquid cooling circuit is a precision cooling circuit arranged specifically to cool the cylinder head in the immediate area around an exhaust passage of the cylinder head.

4. The motorcycle of claim 1, wherein the pair of supply branch lines and the pair of return lines are located substantially entirely within the "V" of the V-twin engine.

5. The motorcycle of claim 1, wherein the right duct is configured to direct air received from the right radiator downwardly away from the motorcycle, and wherein the left duct is configured to direct air received from the left radiator downwardly away from the motorcycle.

6. The motorcycle of claim 1, wherein the right leg shield includes right forward and right rear panels coupled together, wherein the right duct is defined by at least portions of the right forward and right rear panels, wherein the left leg shield includes left forward and left rear panels coupled together, and wherein the left duct is defined by at least portions of the left forward and left rear panels.

7. A motorcycle comprising:

a frame;

an engine coupled to the frame;

right and left engine guards coupled to the frame forwardly of the engine and extending laterally outwardly from the frame;

right and left leg shields coupled to the right and left engine guards, respectively;

a liquid cooling circuit in communication with the engine; and right and left radiators in fluid communication with the liquid cooling circuit and positioned within the right and left leg shields, respectively, wherein the right and left leg shields include a right duct and a left duct, respectively, wherein the right duct is configured to direct air received from the right radiator downwardly away from the motorcycle, and wherein the left duct is configured to direct air received from the left radiator downwardly away from the motorcycle.

8. The motorcycle of claim 7, wherein the liquid cooling circuit is in fluid communication with one or more cylinder heads of the engine and no other portion of the engine.

9. The motorcycle of claim 8, wherein the liquid cooling circuit is a precision cooling circuit arranged specifically to cool the cylinder head in the immediate area around an exhaust passage of the cylinder head.

10. The motorcycle of claim 7, further comprising a thermostat valve and a water pump in fluid communication with the liquid cooling circuit, wherein the thermostat valve is configured to selectively bypass at least one of the right and left radiators depending upon a sensed temperature of liquid coolant within the liquid cooling circuit, and wherein the water pump is positioned between the right and left leg shields, at an elevation substantially lower than the right and left radiators when the motorcycle is in an upright position, wherein the engine is a V-twin engine, and the liquid cooling circuit includes a supply header running from the water pump to the engine and a return header running from the engine to the thermostat valve, and wherein the liquid cooling circuit includes a pair of supply branch lines running from the supply header to each of a first cylinder head and a second cylinder head of the V-twin engine and a pair of return lines running from the first and second cylinder heads to the return header, and wherein the pair of supply branch lines and the pair of return lines are located substantially entirely within the "V" of the V-twin engine.

11. The motorcycle of claim 7, wherein the right leg shield includes right forward and right rear panels coupled together, wherein the right duct is defined by at least portions of the right forward and right rear panels, wherein the left leg shield includes left forward and left rear panels coupled together, and wherein the left duct is defined by at least portions of the left forward and left rear panels.

12. A motorcycle comprising:

a frame;

an engine coupled to the frame;

right and left engine guards coupled to the frame forwardly of the engine and extending laterally outwardly from the frame;

right and left leg shields, each being nested into the respective one of the right and left engine guards and secured thereto;

a liquid cooling circuit in communication with the engine; and right and left radiators in fluid communication with the liquid cooling circuit and positioned within the right and left leg shields, respectively, wherein the right and left leg shields include a right duct and a left duct, respectively, wherein the right duct is configured to direct air received from the right radiator away from the motorcycle, and wherein the left duct is configured to direct air received from the left radiator away from the motorcycle.

13. The motorcycle of claim 12, wherein the liquid cooling circuit is in fluid communication with one or more cylinder heads of the engine and no other portion of the engine.

14. The motorcycle of claim 13, wherein the liquid cooling circuit is a precision cooling circuit arranged specifically to cool the cylinder head in the immediate area around an exhaust passage of the cylinder head.

15. The motorcycle of claim 12, further comprising a thermostat valve and a water pump in fluid communication with the liquid cooling circuit, wherein the thermostat valve is configured to selectively bypass at least one of the right and left radiators depending upon a sensed temperature of liquid coolant within the liquid cooling circuit, and wherein the water pump is positioned between the right and left leg shields, at an elevation substantially lower than the right and left radiators when the motorcycle is in an upright position.

16. The motorcycle of claim 15, wherein the engine is a V-twin engine, and the liquid cooling circuit includes a supply header running from the water pump to the engine and a return header running from the engine to the thermostat valve, and wherein the liquid cooling circuit includes a pair of supply branch lines running from the supply header to each of a first cylinder head and a second cylinder head of the V-twin engine and a pair of return lines running from the first and second cylinder heads to the return header.

17. The motorcycle of claim 16, wherein the pair of supply branch lines and the pair of return lines are located substantially entirely within the "V" of the V-twin engine.

18. The motorcycle of claim 12, wherein the right duct is configured to direct air received from the right radiator downwardly away from the motorcycle, and wherein the left duct is configured to direct air received from the left radiator downwardly away from the motorcycle.

19. The motorcycle of claim 12, wherein the right leg shield includes right forward and right rear panels coupled together, wherein the right duct is defined by at least portions of the right forward and right rear panels, wherein the left leg shield includes left forward and left rear panels coupled together, and wherein the left duct is defined by at least portions of the left forward and left rear panels.

20. The motorcycle of claim 12, wherein each of the right and left leg shields has an inboard portion spaced from a center plane of the motorcycle and an outboard portion spaced further from the center plane.

* * * * *